US007007683B2

(12) United States Patent
Naruse et al.

(10) Patent No.: US 7,007,683 B2
(45) Date of Patent: Mar. 7, 2006

(54) INTERNAL COMBUSTION ENGINE IGNITION APPARATUS

(75) Inventors: Yusuke Naruse, Tokyo (JP); Hisanori Nobe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 67 days.

(21) Appl. No.: 10/800,970

(22) Filed: Mar. 16, 2004

(65) Prior Publication Data

US 2005/0061307 A1 Mar. 24, 2005

(30) Foreign Application Priority Data

Sep. 22, 2003 (JP) ..... P2003-330247

(51) Int. Cl.
*F02P 5/145* (2006.01)

(52) U.S. Cl. ..... 123/618; 123/652; 123/651; 123/644

(58) Field of Classification Search ..... 123/618, 123/652, 651, 644, 650
See application file for complete search history.

(56) References Cited

U.S. PATENT DOCUMENTS 4,397,290 A * 8/1983 Tanaka et al. ..... 123/618
5,070,853 A * 12/1991 Koiwa ..... 123/609
6,336,448 B1 * 1/2002 Furuhata et al. ..... 123/644
6,672,295 B1 * 1/2004 Kohno et al. ..... 123/644
6,932,065 B1 * 8/2005 Naruse et al. ..... 123/644

FOREIGN PATENT DOCUMENTS

JP 9-280147 A 10/1997
JP 2749714 B2 2/1998

* cited by examiner

*Primary Examiner*—Henry C. Yuen
*Assistant Examiner*—Arnold Castro
(74) *Attorney, Agent, or Firm*—Sughrue Mion, PLLC

(57) ABSTRACT

An internal combustion engine ignition apparatus includes a switching circuit having no power supply terminal connected to a power supply such as a battery is constructed, and including an output terminal connected to an ignition coil, an input terminal for receiving an ignition signal voltage and a reference potential terminal connected to a reference potential. In the switching circuit, the terminal structure is simplified, and energization timing and ignition timing can be set more accurately. A current supply circuit is connected between the input terminal and the reference potential terminal, and a current is supplied from the current supply circuit to a drive resistor of the switching element. In this current supply circuit, an energization timing when supply of the driving current is started is controlled by a waveform shaping circuit operating by the ignition signal voltage, and an ignition timing when the driving current is interrupted is controlled.

18 Claims, 11 Drawing Sheets

INTERNAL COMBUSTION ENGINE IGNITION APPARATUS

BACKGROUND OF THE INVENTION

1. Field of the Invention

The present invention relates to an internal combustion engine ignition apparatus mounted in, for example, an automobile, and particularly to an internal combustion engine ignition apparatus in which a current of a primary coil of an ignition coil is interrupted by a switching element, so that a high voltage for ignition is generated in a secondary coil of the ignition coil.

2. Description of the Related Art

In a conventional internal combustion engine ignition apparatus, as a switching circuit for opening and closing a switching element connected to a primary coil of an ignition coil, one having a power supply terminal connected to a battery, an output terminal connected to the primary coil of the ignition coil, an input terminal to which an ignition signal voltage is supplied, and a reference potential terminal is often used. In the internal combustion engine ignition apparatus having the four terminals of the power supply terminal, the output terminal, the input terminal and the reference potential terminal, an ignition control circuit is connected between the power supply terminal and the reference potential terminal, so that a stable voltage from the battery is applied to the ignition control circuit through the power supply terminal, and the ignition control circuit can be stably operated. However, since the four terminals including the power supply terminal is included, the terminal structure becomes complicated.

A conventional internal combustion engine ignition apparatus in which a terminal structure is simplified is disclosed in, for example, Japanese Patent No. 2,749,714. This internal combustion engine ignition apparatus does not have a power supply terminal connected to a battery, but is constructed by three terminals, that is, an output terminal connected to a primary coil of an ignition coil, an input terminal to which an ignition signal voltage is supplied, and a reference potential terminal, and its terminal structure can be simplified.

However, in the internal combustion engine ignition apparatus of this type which has no power supply terminal connected to a battery, since a switching element connected to the primary coil of the ignition coil is directly driven by the ignition signal voltage supplied to the input terminal, there is a disadvantage that variation in the reference potential level of the ignition signal voltage disturbs the timings when the switching element is turned on and off and degrades the ignition characteristic.

The ignition signal voltage is generated by, for example, an electronic circuit for controlling an internal combustion engine, called ECU, or the like. The ignition signal voltage is supplied to the input terminal of a switching circuit of the ignition apparatus. Here, consideration will be paid to a case where the reference potential terminal of the ECU is connected to a common potential point through a first parasitic resistor, and the reference potential terminal of the ignition apparatus is connected to the common potential point through a second parasitic resistor. In this case, the ECU is used for not only generation of the ignition signal voltage but also other signal processing, and in the case where the ignition signal voltage is generated in a state where a current flows through the first parasitic resistor, the ignition signal voltage is supplied to the input terminal of the ignition apparatus in the form in which a base voltage generated at both ends of the first parasitic resistor is added to the ignition signal voltage.

Since the level of the base voltage included in the ignition signal voltage is varied depending on the current of the ECU or the like, a level variation corresponding to the base voltage is eventually given to the ignition signal voltage. The ignition apparatus brings the switching element into an on state at, for example, an energization timing when the level becomes a predetermined value or higher in a rising portion of the ignition signal voltage, and brings the switching element into an off state at an ignition timing when the level becomes the predetermined value or lower in a falling portion of the ignition signal voltage. However, the variation in the base voltage included in the ignition signal voltage disturbs these timings and degrades the ignition characteristic of the ignition apparatus.

The variation in the energization timing varies, for example, an energization time of the primary coil of the ignition coil, and varies ignition energy. Besides, the variation in the ignition timing varies an ignition timing to an engine, and lowers the output of the internal combustion engine. At the worst, due to a rise in the level of the ignition signal voltage, it becomes impossible to turn off the switching element in the falling portion of the ignition signal voltage, and misfire is caused.

SUMMARY OF THE INVENTION

The present invention proposes an internal combustion engine ignition apparatus which is improved, in a switching circuit having no power supply terminal connected to a battery and having an output terminal, an input terminal and a reference potential terminal, so that an ignition characteristic is not degraded by a variation in the reference potential level of an ignition signal voltage.

An internal combustion engine ignition apparatus according to the invention includes an ignition coil and a switching circuit. The ignition coil has a primary coil and a secondary coil, and the switching circuit interrupts a current of the primary coil of the ignition coil on the basis of an ignition signal voltage to generate a high voltage for ignition in the secondary coil of the ignition coil. The ignition signal voltage used in this invention is a pulse-like voltage including a rising portion and a falling portion. The switching circuit does not have a power supply terminal connected to a battery, but is constructed by an output terminal connected to the primary coil of the ignition coil, an input terminal for receiving the ignition signal voltage, and a reference potential terminal.

The switching circuit includes a switching element, a driver resistor for the switching element, a current supply circuit and a waveform shaping circuit. The switching element is connected between the output terminal and the reference potential terminal, applies the current to the primary coil of the ignition coil in an on state, and interrupts the current of the primary coil when an off state is caused. The current supply circuit is connected between the input terminal and the reference potential terminal and supplies a current to the drive resistor. The waveform shaping circuit controls a driving current from the current supply circuit to the drive resistor, brings the switching element into the on state on the basis of start of supply of the driving current, and brings the switching element into the off state on the basis of interruption of the driving current.

The waveform shaping circuit includes a comparison signal generation circuit for generating a comparison signal on the basis of the ignition signal voltage, and a reference signal generation circuit for generating a reference signal on the basis of the ignition signal voltage, starts to supply the driving current to the drive resistor from the current supply circuit when the comparison signal becomes larger than the reference signal in the rising portion of the ignition signal voltage, and interrupts the driving current when the comparison signal becomes smaller than the reference signal in the falling portion of the ignition signal voltage.

In the internal combustion engine ignition apparatus of the invention, the switching circuit does not have the power supply terminal connected to a battery, but has the three terminals of the output terminal, the input terminal and the reference potential terminal, and the terminal structure can be simplified. In addition, the current supply circuit includes the waveform shaping circuit, the waveform shaping circuit includes the comparison signal generation circuit for generating the comparison signal on the basis of the ignition signal voltage, and the reference signal generation circuit for generating the reference signal on the basis of the ignition signal voltage, starts to supply the driving current to the drive resistor from the current supply circuit when the comparison signal becomes larger than the reference signal in the rising portion of the ignition signal voltage, and interrupts the driving current when the comparison signal becomes smaller than the reference signal in the falling portion of the ignition signal voltage. Accordingly, even if the reference potential level of the ignition signal voltage is varied, the switching element can be certainly turned on and off at more accurate timings, and the degradation of an ignition characteristic can be avoided.

DETAILED DESCRIPTION OF THE INVENTION

Hereinafter, embodiments of the invention will be described with reference to the drawings.

Embodiment 1

Figure 1:
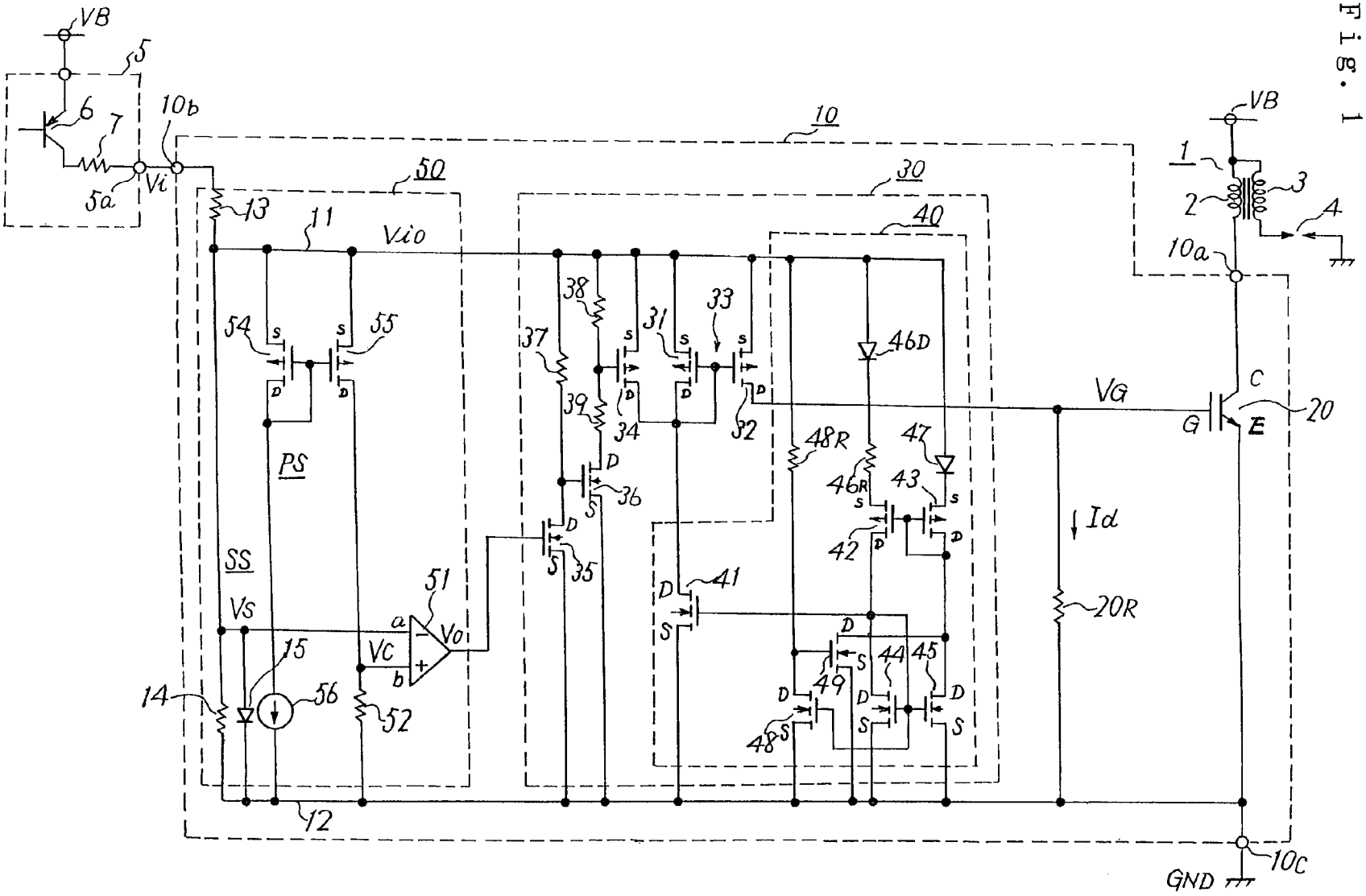
FIG. 1 is an electrical diagram showing embodiment 1 of an internal combustion engine ignition apparatus of the invention.
Figure 2:
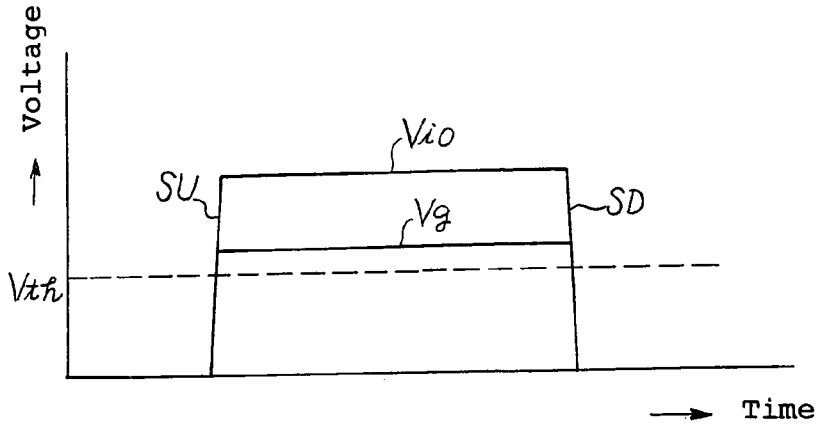
FIG. 2 is a characteristic diagram for explaining the operation of the embodiment 1.
Figure 3:
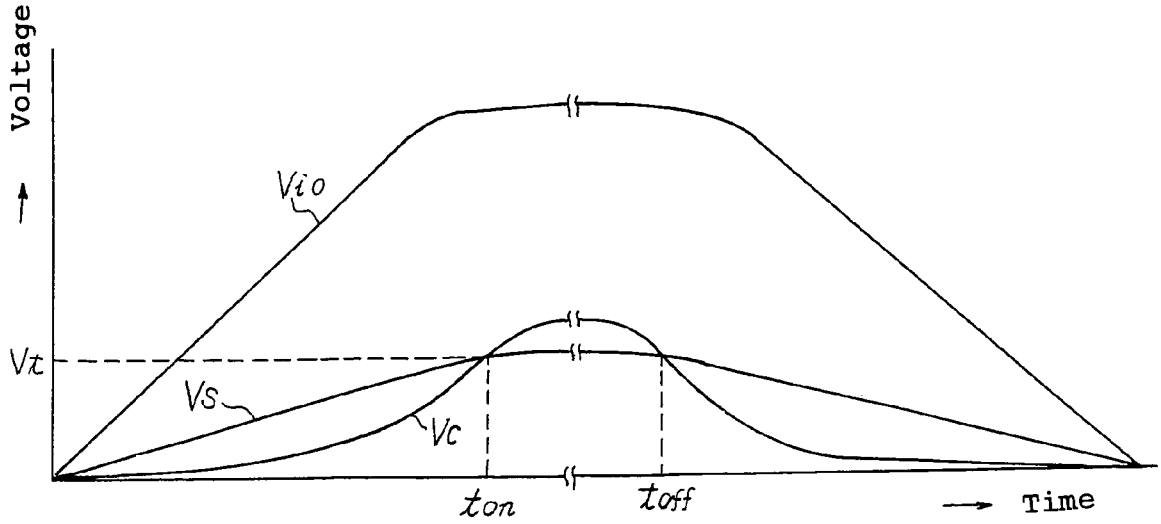
FIG. 3 is a characteristic diagram for explaining the operation of the embodiment 1.

FIG. 1 shows embodiment 1 of an internal combustion engine ignition apparatus of the invention. FIGS. 2 and 3 are characteristic diagrams for explaining the operation of the embodiment 1.

The internal combustion engine ignition apparatus of the embodiment 1 is an ignition apparatus for an internal combustion engine mounted in an automobile, and includes an ignition coil 1, an ignition driving circuit 5, and a switching circuit 10. The ignition coil 1 includes a primary coil 2 and a secondary coil 3 and is connected to a power supply terminal VB such as an on-board battery. The on-board battery has, for example, 12 volts, and the power supply terminal VB has, for example, 12 volts. A spark plug 4 is connected to the secondary coil 3. This spark plug 4 is disposed in a combustion chamber of the internal combustion engine, and ignites fuel, such as gasoline, supplied into the combustion chamber to burn it.

The ignition driving circuit 5 is included in an electrical control unit (ECU) mounted in the automobile. This electrical control unit has a built-in microprocessor, memory, input/output circuit and the like, and intensively controls various electric loads of the automobile. The ignition driving circuit 5 includes, for example, a PNP driving transistor 6. This driving transistor 6 is a bipolar transistor, its emitter is connected to the power supply terminal VB or an internal power supply of the ECU, and its collector is connected to an ignition signal terminal 5*a* through a resistor 7. The base of the driving transistor 6 is controlled by the electrical control unit (ECU), and an ignition signal voltage Vi is generated at the ignition signal terminal 5*a*. This ignition signal voltage Vi is the signal voltage having, for example, a pulse shape waveform.

The switching circuit 10 is constructed by three terminals, that is, an output terminal 10*a*, an input terminal 10*b* and a reference potential terminal 10*c*. The output terminal 10*a* is directly connected to the primary coil 2 of the ignition coil 1, and the input terminal 10*b* is directly connected to the ignition signal terminal 5*a* of the ignition driving circuit 5. Besides, the reference potential terminal 10*c* is directly connected to a common potential point GND such as a car body. This common potential point GND is generally called earth, and reference potential terminals of various electronic equipments mounted in the automobile, for example, the electrical control unit (ECU) are also connected in common to the common potential GND. The switching circuit 10 does not have a power supply terminal connected to the power supply terminal VB of the battery or the like, and the terminal structure of this switching circuit 10 is constructed by the three terminals, that is, the output terminal 10*a*, the input terminal 10*b* and the reference potential terminal 10*c*. Since the terminal structure made of the three terminals do not include the power supply terminal, it is simplified.

The inner structure of the switching circuit 10 will be described. This switching circuit 10 includes an ignition signal line 11, a reference potential line 12, a switching element 20, a drive resistor 20R for the switching element 20, a current supply circuit 30, a constant current circuit 40, and a waveform shaping circuit 50.

The ignition signal line 11 is connected to a connection point between input resistors 13 and 14, and the reference potential line 12 is connected to the reference potential terminal 10*c*. The input resistors 13 and 14 are connected in series to each other between the input terminal 10*b* and the reference potential line 12, divide the ignition signal voltage Vi outputted to the ignition signal terminal 5*a*, and outputs a voltage-divided ignition signal voltage Vio to the ignition signal line 11.

The switching element 20 is a power switching element for turning on and off an energization circuit for the primary coil 2 of the ignition coil 1. In the embodiment 1, a power semiconductor switching element called an IGBT is used. This IGBT is an insulated-gate bipolar transistor, and includes three terminals of a collector C, an emitter E, and a gate G. The collector C of this switching element 20 is directly connected to the output terminal 10*a*, and the emitter E is directly connected to the reference potential terminal 10*c*. One end of the drive resistor 20R is directly connected to the gate G of the switching element 20, the other end thereof is directly connected to the emitter E of the switching element 20, and this drive resistor 20R supplies a gate voltage Vg to the switching element 20.

FIG. 2 shows the change of the ignition signal voltage Vio and the gate voltage Vg. In FIG. 2, the vertical axis indicates the voltage, and the horizontal axis indicates the time. The ignition signal voltage Vio is a pulse-like voltage, and includes a rising portion SU at a front end and a falling portion SD at a rear end. Since the gate voltage Vg is generated on the basis of the ignition signal voltage Vio, it is also a pulse-like voltage similar to the ignition signal voltage Vio.

In the rising portion SU of the ignition signal voltage Vio, the current supply circuit 30 starts to supply the driving current to the drive resistor 20R, the gate voltage Vg generated at both ends of the drive resistor 20R rises, and the switching element 20 is turned on at a timing ton when this gate voltage Vg exceeds a threshold voltage Vth of the switching element 20, and energization to the primary coil 2 of the ignition coil from the power supply terminal VB is started. The timing ton is the energization timing.

Besides, in the falling portion SD of the ignition signal voltage Vio, the switching element 20 is turned off at a timing toff when the gate voltage Vg becomes the threshold voltage Vth or lower. In the on state, the switching element 20 sends a current between the collector C and the emitter E, and sends the current to the primary coil 2 of the ignition coil 1. At the timing toff when the switching element 20 is turned off, the current flowing through the primary coil 2 is interrupted, and a high voltage for ignition is generated in the secondary coil 3 and the spark plug 4 is made to generate a spark. The timing toff is the ignition timing.

The current supply circuit 30 is connected between the ignition signal line 11 and the reference potential line 12. This current supply circuit 30 includes a current mirror circuit 33 having two output transistors 31 and 32. The transistors 31 and 32 are, for example, P-channel MOS transistors, both of their sources S are directly connected to the ignition signal line 11, and their gates are connected to each other and are connected to a drain D of the transistor 31. The drain D of the output transistor 31 is connected to the reference potential line 12 through a constant current transistor 41 of the constant current circuit 40, and a drain D of the output transistor 32 is connected to the reference potential line 12 through the drive resistor 20R.

The constant current circuit 40 includes upper transistors 42 and 43, lower transistors 44 and 45 and starting transistors 48 and 49 as well as the constant current circuit 41. The upper transistors 42 and 43 are, for example, P-channel MOS transistors, and the constant current transistor 41, the lower transistors 44 and 45, and starting transistors 48 and 49 are N-channel MOS transistors.

A source S of the upper transistor 42 is connected to the ignition signal line 11 through a resistor 46R and a diode 46D, and a source S of the transistor 43 is connected to the ignition signal line 11 through a diode 47. An anode of the diode 46D is connected to the ignition signal line 11, and a cathode thereof is connected to the source S of the transistor 42 through the resistor 46R. An anode of the diode 47 is connected to the ignition signal line 11, and a cathode thereof is connected to the source S of the transistor 43. Gates of these transistors 42 and 43 are connected to each other and are connected to a drain D of the transistor 43.

Drains D of the lower transistors 44 and 45 are directly connected to the drains D of the upper transistors 42 and 43, and sources S of the transistors 44 and 45 are directly connected to the reference potential line 12. Gates of these transistors 44 and 45 are connected to each other, and are directly connected to a gate of the constant current transistor 41, and are further connected to the drain D of the transistor 42.

A drain D of the starting transistor 48 is directly connected to a gate of the transistor 49 and is connected to the ignition signal line 11 through a starting resistor 48R. A gate of the transistor 48 is directly connected to the gates of the lower transistors 44 and 45, and a source S of this transistor 48 is directly connected to the reference potential line 12. A drain D of the transistor 49 is connected to the gate and the drain D of the transistor 43 and is connected to the drain D of the transistor 45. A source S of this transistor 49 is directly connected to the reference signal line 12.

The constant current circuit 40 is started by the starting transistors 48 and 49. First, in the rising portion SU of the ignition signal voltage Vio, the starting transistor 49 is turned on by the increase of the ignition signal voltage Vio, and the gate potential of the transistors 42 and 43 is made to approach the reference potential of the reference potential line 12. As a result, currents flow between the sources S and the drains D of the transistors 42 and 43, the gate potentials of the transistors 44, 45 and 48 approach the reference potential of the reference potential line 12, and currents flow between the sources S and the drains D of these transistors 44, 45 and 48. Since the gate potentials of the transistors 44, 45 and 48 are kept at a specified value, the currents flowing through the transistors 42 and 44 and the transistors 43 and 45 are kept at constant values, and the constant current transistor 41 operates to draw a constant current from the output transistors 31 and 32. As stated above, the constant current transistor 41 of the constant current circuit 40 operates to draw the constant current from the output transistors 31 and 32 on the basis of the ignition signal voltage Vio of the ignition signal line 11.

A control transistor 34 is connected to the output transistor 31 of the current supply circuit 30, and the control transistor 34 is on/off controlled by input transistors 35 and 36. The control transistor 34 is a P-channel MOS transistor, its source is directly connected to the source S of the output transistor 31, and a drain D of the control transistor 34 is directly connected to the drain D of the output transistor 31. The input transistors 35 and 36 are N-channel MOS transistors. A drain D of the input transistor 35 is connected to the ignition signal line 11 through a resistor 37, and its source S is directly connected to the reference potential line 12. A drain D of the input transistor 36 is connected to the ignition signal line 11 through resistors 38 and 39, and its source S is directly connected to the reference potential line 12. A connection point between the resistors 38 and 39 is connected to a gate of the control transistor 34.

In the rising portion SU of the ignition signal voltage Vio, first, the input transistor 35 is turned off, and as a result, the input transistor 36 is turned on, and the control transistor 34 is also turned on. When the control transistor 34 is in an on state, even if the constant current transistor 41 draws the constant current, all the current bypasses the output transistor 31 by the control transistor 34 and flows, so that the current does not flow through the output transistors 31 and 32.

The waveform shaping circuit 50 is connected between the ignition signal line 11 and the reference potential line 12. The waveform shaping circuit 50 includes a reference signal generation circuit SS, a comparison signal generation circuit PS, a comparator 51, and an input resistor 52. The reference signal generation circuit SS includes the input resistor 14 and a diode 15 connected in parallel to that. An anode of the diode 15 is directly connected to the ignition signal line 11, a cathode thereof is directly connected to the reference potential line 12, and a reference signal Vs is generated at the anode of the diode 15.

The comparison signal generation circuit PS is connected between the ignition signal line 11 and the reference potential line 12. The comparison signal generation circuit PS includes a pair of MOS transistors 54 and 55 and a proportional current source 56. The transistors 54 and 55 are P-channel MOS transistors, their sources S are directly connected to the ignition signal line 11, and their gates are connected to each other and are connected to a drain D of the transistor 54. The proportional current source 56 is connected between the drain D of the transistor 54 and the reference potential line 12. The input resistor 52 is connected between a drain D of the transistor 55 and the reference potential 12, and this input resistor 52 generates a comparison signal Vc.

The comparator 51 includes a minus side input "a", a plus side input "b", and an output "c". The minus side input "a" is connected to the anode of the diode 15, and receives the reference signal Vs. The plus side input "b" is connected to a connection point between the drain D of the transistor 55 and the input resistor 52, and receives the comparison signal Vc. The output "c" of the comparator 51 is directly connected to a gate of the input transistor 35 of the current supply circuit 30. A waveform shaping output Vo is generated at the output "c" of the comparator 51, and this is supplied to the gate of the input transistor 35.

FIG. 3 is a characteristic diagram for explaining the operation of the waveform shaping circuit 50. Also in FIG. 3, the vertical axis indicates the voltage, and the horizontal axis indicates the time. Although the ignition signal voltage Vio is a pulse-like voltage as shown in FIG. 2, FIG. 3 shows its rising portion SU and its falling portion SD while the time axis is magnified. The level of the ignition signal voltage Vio is increased with the lapse of time in the rising portion SU, and the level of the ignition signal voltage Vio is decreased with the lapse of time in the falling portion SD.

In the rising portion SU of the ignition signal voltage Vio, as the ignition signal voltage Vio is increased, the reference signal Vs is successively increased up to a forward direction saturation voltage of the diode 15. On the other hand, as the level of the ignition signal voltage Vio is increased, the proportional current source 56 draws a proportional current, which is increased depending on that, from the transistors 54 and 55, so that the comparison signal Vc is also successively increased as the ignition signal voltage Vio is increased. The comparison signal Vc reaches a voltage level Vt exceeding the reference signal Vs at an energization timing ton, and at the energization timing ton, the waveform shaping output Vo at the output "c" of the comparator 51 is changed from a low level to a high level. Besides, in the falling portion SD of the ignition signal voltage Vio, at an ignition timing toff, the comparison signal Vc again crosses the voltage level Vt and becomes smaller than the reference signal Vs, and the waveform shaping output Vo at the output "c" is changed from the high level to the low level.

At the energization timing ton, the waveform shaping output Vo comes to have the high level, so that the input transistor 35 is turned on, and according to this, the transistor 36 is turned off, and the control transistor 34 is also turned off. The control transistor 34 is turned off, so that the constant current transistor 41 causes the constant current to flow through the output transistors 31 and 32, and the output transistor 32 starts to supply a driving current Id to the drive resistor 20R. The driving current Id is made constant by the constant current circuit 40.

At the ignition timing toff, the waveform shaping output Vo comes to have the low level, so that the input transistor 35 is turned off, and the control transistor 34 is turned on. The control transistor 34 is turned on, so that the currents of the output transistors 31 and 32 are bypassed to the control transistor 34, and the driving current Id to the drive resistor 20R is interrupted.

At the energization timing ton of the rising portion SU of the ignition signal voltage Vio, the supply of the driving current Id, which is made constant, is started, and the gate voltage Vg exceeds the threshold voltage Vth of the switching element 20, the switching element 20 is turned on, and energization from the power supply terminal VB to the primary coil 2 of the ignition coil 1 is started. At the ignition timing toff of the falling portion SD, the driving current Id is interrupted, the high voltage for ignition is generated in the secondary coil 3 of the ignition coil 1, and the spark plug 4 is ignited.

As described above, in the embodiment 1, both the current supply circuit 30 and the waveform shaping circuit 50 are connected between the ignition signal line 11 and the reference potential line 12, and in the rising portion SU and the falling portion SD of the ignition signal voltages Vi and Vio, the waveform shaping circuit 50 performs the supply start and the interruption of the driving current Id to the drive resistor 20R through the current supply circuit 30. On the basis of this structure, the switching circuit 10 does not have a power supply terminal connected to the battery, but is constructed by the three terminals of the output terminal 10*a*, the input terminal 10*b* and the reference potential terminal 10*c*. Since the switching circuit 10 does not have the power supply terminal, the terminal structure of the switching circuit 10 can be simplified.

In the embodiment 1, the waveform shaping circuit 50 generates the reference signal Vs on the basis of the ignition signal voltage Vio by the reference signal generation circuit SS, and generates the comparison signal Vc by the comparison signal generation circuit PS. The reference signal Vs and the comparison signal Vc are generated on the basis of the ignition signal voltage Vio. Even if the ignition signal voltage Vio includes a changing base voltage, since the reference signal Vs and the comparison signal Vc are newly generated based on the ignition signal voltage Vio including this base voltage, the energization timing ton and the ignition timing toff can be more accurately set irrespective of the change of the base voltage. Accordingly, it is possible to prevent the energization timing and the ignition timing from being disturbed because of the base voltage, and the switching element 20 can be turned on and off at more accurate energization timing and ignition timing. It is also possible to avoid the misfire as the worst case, that is, a case where the driving current Id can not be interrupted at the ignition timing toff.

In the embodiment 1, the constant current circuit 40 uses the changing ignition signal voltage Vio as the voltage source, draws the constant current from the output transistors 31 and 32 of the current supply circuit 30, and supplies the driving current Id, which is made constant, to the drive resistor 20R. In the switching circuit 10 having no power supply terminal, the constant current circuit 40 prevents the ignition characteristic from deteriorating by the variation of the ignition signal voltage Vio in the period when the switching element 20 is turned on. For example, in the on state of the switching element 20, even if the level of the ignition signal voltage Vio is low, since the driving current Id. becomes a specific current which is made constant, the gate voltage Vg is also kept at a specific value, and depending on that, at the ignition timing toff, the flowing current is interrupted in the state where the flowing current of the primary coil 2 of the ignition coil rises up to a sufficient value, so that it is possible to prevent the ignition energy of the internal combustion engine from becoming insufficient because of insufficiency of the flowing current or to prevent the misfire from occurring at the worst. In addition, it is also possible to avoid the variation of the gate voltage Vg due to noise in the on period of the switching element 20, and it is also possible to prevent a high voltage for ignition from becoming insufficient because of the noise and the misfire from occurring.

Incidentally, in the embodiment 1, although the respective transistors of the current supply circuit 30 are constructed by the MOS transistors, it is also possible to change all the transistors to bipolar transistors. In this case, the P-channel transistors 31, 32, 34, 42 and 43 are replaced by PNP bipolar transistors, and the N-channel transistors 35, 36, 41, 44, 45, 48 and 49 are replaced by NPN bipolar transistors, so that the same function can be achieved.

Embodiment 2

Figure 4:
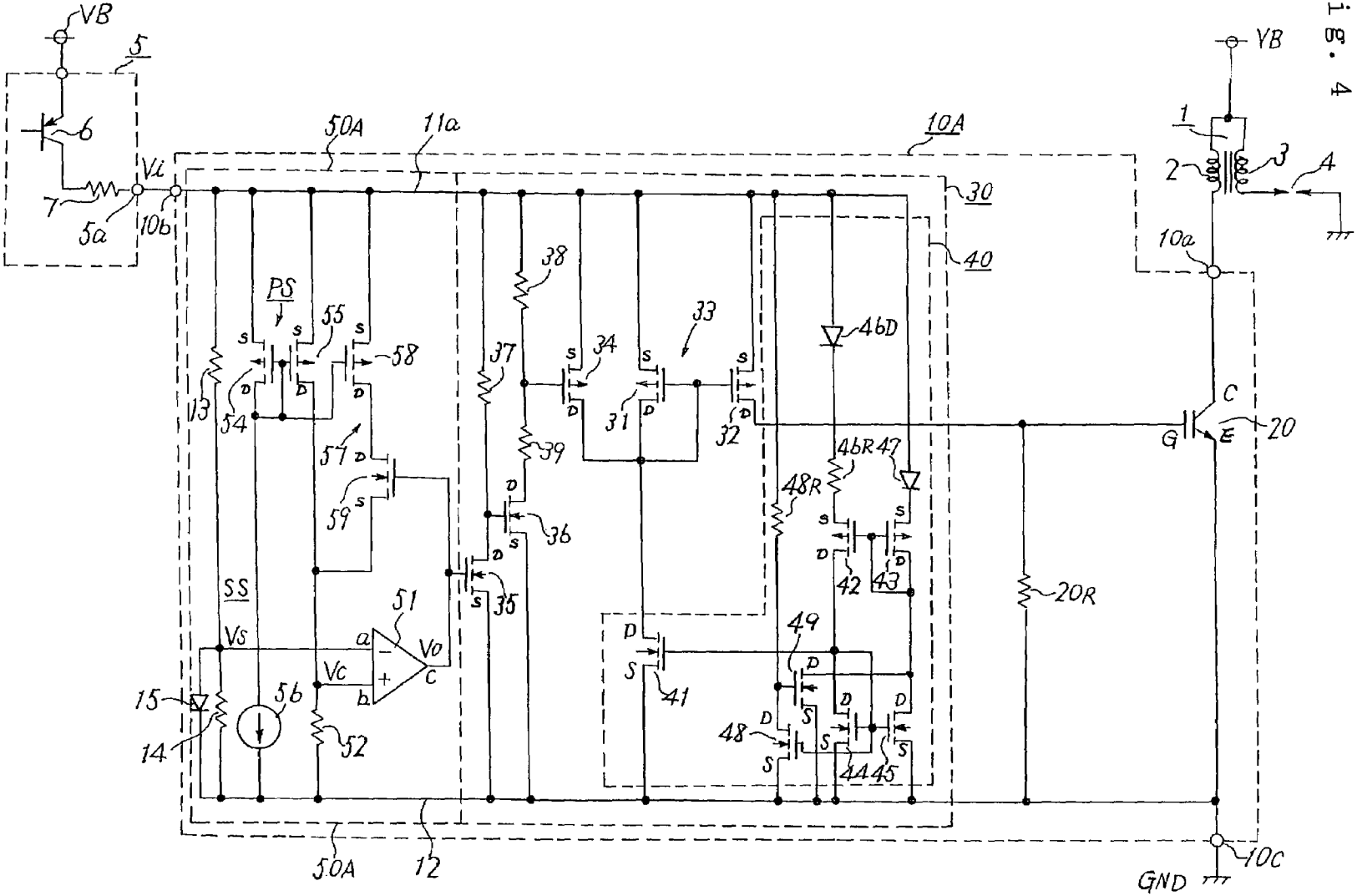
FIG. 4 is an electrical diagram showing embodiment 2 of an internal combustion engine ignition apparatus of the invention.
Figure 5:
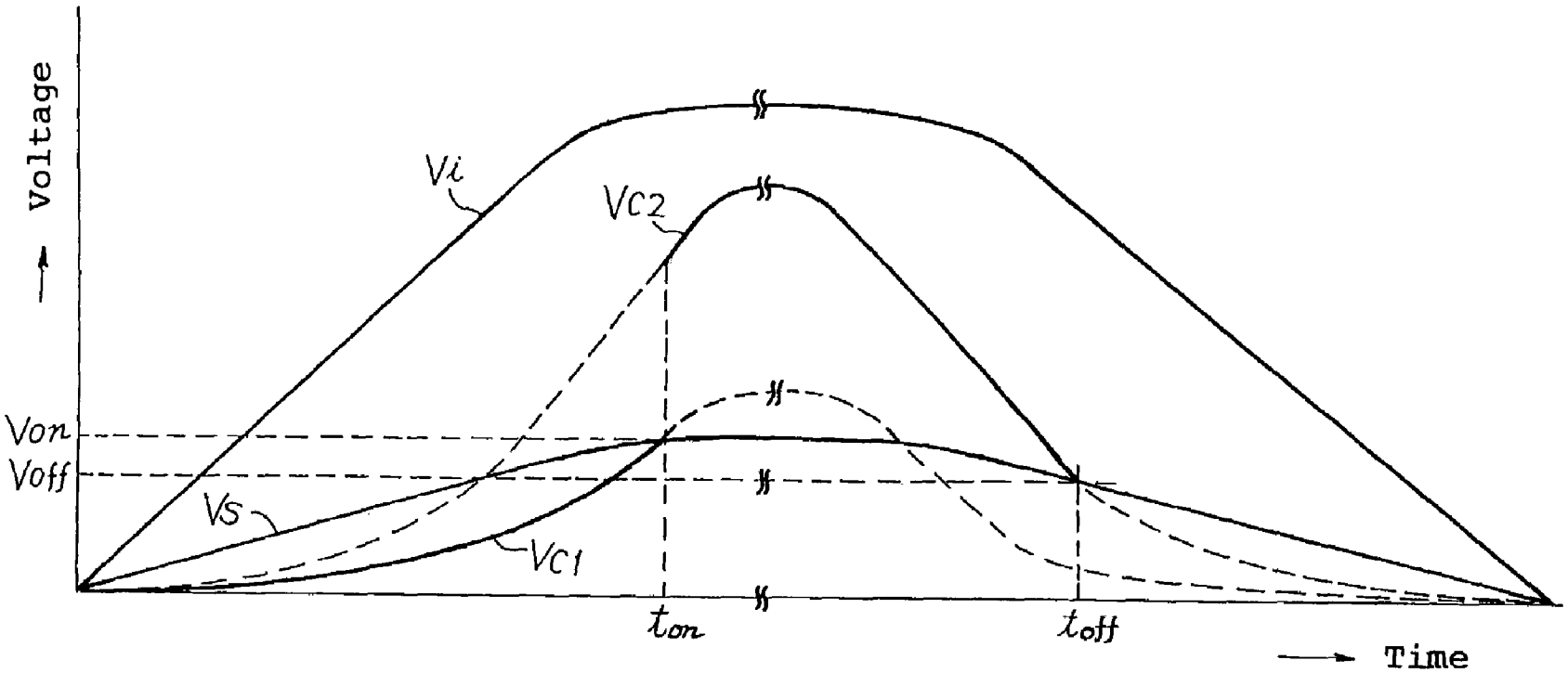
FIG. 5 is a characteristic diagram for explaining the operation of the embodiment 2.

FIG. 4 shows embodiment 2 of an internal combustion engine ignition apparatus of the invention, and FIG. 5 is an explanatory diagram of the operation of the embodiment 2.

The embodiment 2 shown in FIG. 4 includes a switching circuit 10A. The switching circuit 10A is constructed by three terminals, that is, an output terminal 10*a*, an input terminal 10*b* and a reference potential terminal 10*c* similarly to the switching circuit 10 shown in FIG. 1. The input terminal 10*a* is directly connected to a primary coil 2 of an ignition coil 1, the input terminal 10*b* is directly connected to an ignition signal terminal 5*a* of an ignition driving circuit 5, and the reference potential terminal 10*c* is directly connected to a reference potential point GND.

This switching circuit 10A includes a waveform shaping circuit 50A instead of the waveform shaping circuit 50 of FIG. 1, and in this embodiment 2, instead of the ignition signal line 11 of FIG. 1, an ignition signal line 11*a* directly connected to the ignition signal voltage terminal 5*a* of the ignition driving circuit 5 is used, and an ignition signal voltage Vi is directly supplied to the ignition signal voltage line 11*a*. The ignition signal voltage Vi is indicated by a curved line Vi of FIG. 5. A switching element 20, a drive resistor 20R, a current supply circuit 30, and a constant current circuit 40 are constructed similarly to those of FIG. 1. The same parts are denoted by the same symbols and the explanation will be omitted.

In the embodiment 2, input resistors 13 and 14 are connected in series to each other between the ignition signal voltage line 11*a* and the reference potential line 12, and a diode 15 is connected in parallel to the input resistor 14. An anode of the diode 15 is connected to a mutual connection point between the input resistors 13 and 14, and a cathode thereof is connected to a reference potential line 12. In the embodiment 2, a reference signal Vs is generated at the mutual connection point between the input resistors 13 and 14. The reference signal Vs is equal to the forward direction voltage of the diode 15 and changes like a curved line Vs shown in FIG. 5 correspondingly to the ignition signal voltage Vi shown in FIG. 5.

The waveform shaping circuit 50A includes a comparator 51, an input resistor 52, a reference signal generation circuit SS, a comparison signal generation circuit PS, and a level up circuit 57. The comparator 51, the input resistor 52, the reference signal generation circuit SS and the comparison signal generation circuit PS are constructed similarly to those of the embodiment 1 shown in FIG. 1. The waveform shaping circuit 50A used in the embodiment 2 is such that the level up circuit 57 is added to the waveform shaping circuit 50 used in the embodiment 1. In the waveform shaping circuit 50A, since the level up circuit 57 is added, a voltage level Von of the comparison signal Vs at an energization timing ton and a voltage level Voff of the comparison signal Vc at an ignition timing toff are different from each other, and the voltage level Voff is set to be smaller than the voltage level Von. The waveform shaping circuit 50A of this type is the waveform shaping circuit having a hysteresis characteristic.

FIG. 5 shows a rising portion SU and a falling portion SD of the ignition signal voltage Vi, which are magnified as in FIG. 3. Also in FIG. 5, the vertical axis indicates the voltage and the horizontal axis indicates the time. FIG. 5 shows a comparison signal Vc1 for setting the energization timing ton, and a comparison signal Vc2 for setting the ignition timing toff. The comparison signal Vc1 is the comparison signal generated by the comparison signal generating circuit PS in the state where the level up circuit 57 is not operated and is the same as the comparison signal Vc of the embodiment 1. The comparison signal Vc2 is the comparison signal in the state where the level up circuit 57 is operated and is the signal the level of which is raised as compared with the comparison signal Vc1.

The level up circuit 57 is connected between the ignition signal voltage line 11*a* and the reference potential line 12. The level up circuit 57 includes transistors 58 and 59. The transistor 58 is a P-channel MOS transistor, and the transistor 59 is an N-channel MOS transistor. A source S of the transistor 58 is directly connected to the ignition signal voltage line 11*a*, a drain D thereof is directly connected to a drain D of the transistor 59, and a gate thereof is directly connected to a drain D of a transistor 54. A source S of the transistor 59 is connected to a plus input "b" of the comparator 51, and a gate thereof is connected to an output "c" of the comparator 51.

In the level up circuit 57, when a waveform shaping output Vo at the output "c" of the comparator 51 is on a high level, the transistor 59 is brought into an on state, so that a comparison signal Vc generated by the input resistor 52 is leveled up, and when the ignition signal voltage Vi indicated by the curved line Vi of FIG. 5 is given, the leveled-up comparison signal Vc2 as indicated by the curved line Vc2 of FIG. 5 is generated. The leveled-up comparison signal Vc2 also changes its level in accordance with the level change of the ignition signal voltage Vi similarly to the comparison signal Vc1.

When the ignition signal voltage Vi indicated by the curved line Vi of FIG. 5 is supplied from the ignition driving circuit 5, as shown in FIG. 5, the reference voltage Vs indicated by the curved line Vs is increased in accordance with the forward direction voltage characteristic of the diode 15, and reaches an almost constant saturation voltage. Besides, since a comparison signal generation circuit PS increases a current supplied to the input resistor 52 as the level of the ignition signal voltage Vi is increased, the comparison signal Vc at the plus side input "b" of the waveform shaping comparator 51 is increased along the curved line Vc1 of FIG. 5.

In the rising portion SU of the ignition signal voltage Vi, at the energization timing ton when the comparison signal Vc1 exceeds the reference signal Vs, the waveform shaping output Vo at the output "c" of the comparator 51 is changed to the high level. Since the waveform shaping output Vo comes to have the high level, an input transistor 35 of the current supply circuit 30 is turned on, and a control transistor 34 is turned off, so that a voltage exceeding the threshold voltage Vth of the switching element 20 is generated at the drive resistor 20R of the switching element 20, and the switching element 20 is turned on. In addition, the waveform shaping output Vo of the comparator 51 comes to have the high level, so that the transistor 59 of the level up circuit 57 is turned on, and on the basis of the on of the transistor 59, a current is supplied to the input resistor 52 from the transistor 59, the comparison signal Vc is brought into the level up state and rises to the leveled-up comparison signal Vc2, and then, the signal is increased along the curved line Vc2 in accordance with the increase of the level of the ignition signal voltage Vi.

In the falling portion SD of the ignition signal voltage Vi, as the level of the ignition signal voltage Vi falls along the curved line Vc2, the level of the comparison signal Vc falls. At the ignition timing toff when the comparison signal Vc is decreased to the level of the reference signal Vs or lower, the comparator 51 is turned off, and the waveform shaping output Vo at the output "c" is again changed to the low level. As the waveform shaping output Vo is changed to the low level, the input transistor 35 of the current supply circuit 30 is turned off at the ignition timing toff, and the control transistor 34 is turned on, so that the switching element 20 is turned off, and the current flowing through the primary coil 2 of the ignition coil 1 is interrupted, and accordingly, the high-voltage for ignition is generated in the secondary coil 3 of the ignition coil 1, and the internal combustion engine is ignited.

In FIG. 5, the voltage Von indicates the voltage level at the time when the comparison signal Vc1 exceeds the reference signal Vs at the energization timing ton, and the voltage Voff indicates the voltage level at the time when the comparison signal Vc2 becomes the reference signal Vs or lower at the ignition timing toff. By the operation of the level up circuit 57, the relation of the voltage Von>Voff is established.

Also in the embodiment 2, the switching circuit 10A does not have a power supply terminal connected to a battery, but is constructed by the three terminals of the output terminal 10*a*, the input terminal 10*b* and the reference potential terminal 10*c*, so that its terminal structure can be simplified. Besides, also in the embodiment 2, since the reference signal Vs and the comparison signal Vc are newly generated on the basis of the ignition signal voltage Vi, the energization timing ton and the ignition timing toff can be set more accurately irrespective of the variation of the base voltage included in the ignition signal voltage Vi.

In addition, in the embodiment 2, since the level up circuit 57 is attached, the comparison signal Vc is leveled up by the operation of the level up circuit 57 according to the on of the comparator 51, and even if the ignition signal voltage Vi is varied and the comparison signal Vc is varied by noise, the operation of the comparator 51 is always stabilized. This causes the waveform shaping circuit 50A to operate on the basis of the ignition signal voltage Vi, gives the waveform shaping circuit 50A a sufficient margin for a potential difference from the reference potential GND, is effective to stabilize the operation of the current supply circuit 30, and is effective to obtain the sufficient high voltage for ignition at the ignition timing toff after the energization to the primary coil 2 of the ignition coil 1.

Embodiment 3

Figure 6:
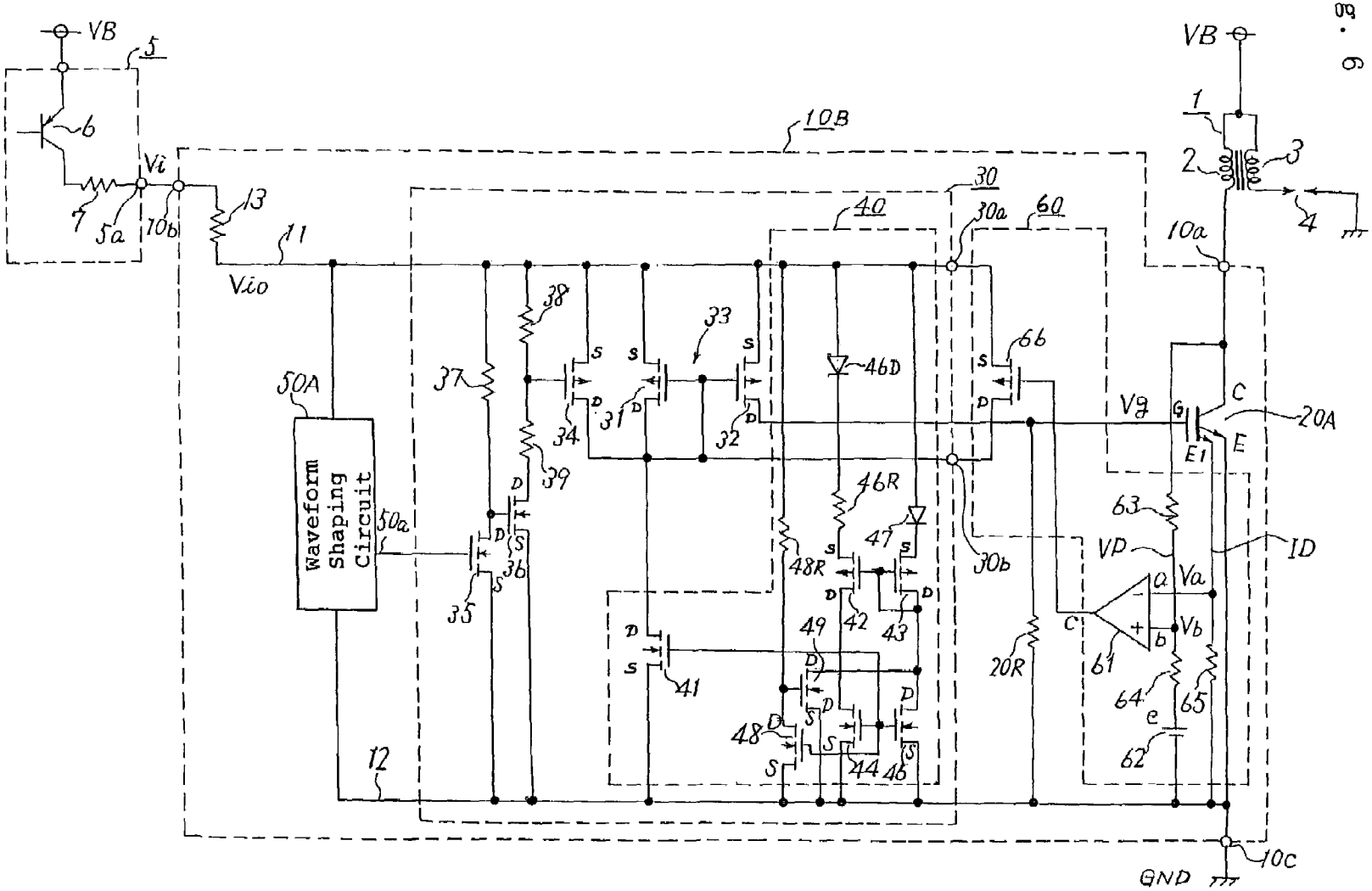
FIG. 6 is an electrical diagram showing embodiment 3 of an internal combustion engine ignition apparatus of the invention.

FIG. 6 shows embodiment 3 of an internal combustion engine ignition apparatus of the invention. This embodiment 3 uses a switching circuit 10B. The switching circuit 10B is such that a current limiting circuit 60 is added to the switching circuit 10 of the embodiment 1 shown in FIG. 1. Along with this, instead of the switching element 20 shown in FIG. 1, a switching element 20A having an auxiliary emitter E1 is used. Since the others are constructed similarly to the embodiment 1 of FIG. 1, the same parts are denoted by the same symbols and the explanation will be omitted. Incidentally, in this embodiment 3, the waveform shaping circuit 50A shown in FIG. 4 is used.

The switching element 20A is an IGBT, and this includes a collector C, a main emitter E, the auxiliary emitter E1, and a gate G. The collector C is directly connected to an output terminal 10*a* of the switching circuit 10B, and the main emitter E is directly connected to a reference potential terminal 10*c* thereof.

The current limiting circuit 60 is a protection circuit which limits a flowing current of the switching element 20A in an on state of the switching element 20A, and serves to prevent the current flowing through the switching element 20A from becoming excessive. This current limiting circuit 60 includes a current limiting comparator 61, a reference potential source 62, detection resistors 63, 64 and 65, and a current limiting transistor 66. The detection resistor 65 is connected to the auxiliary emitter E1, and constitutes a flowing current detection circuit ID for detecting the flowing current of the switching element 20A. The detection resistors 63 and 64 are connected to the collector C, that is, the output terminal 10*a*, and constitutes an output voltage detection circuit VD for detecting an output voltage at the output terminal 10*a*.

The current limiting comparator 61 includes a minus side input "a", a plus side input "b", and an output "c". The detection resistors 63 and 64 constituting the output voltage detection circuit VD, together with the reference potential source 62, are connected in series to each other between the collector C of the switching element 20A and a reference potential line 12. The detection resistor 63 is directly connected to the collector C, a minus side terminal of the reference potential source 62 is directly connected to the reference potential line 12, and the detection resistor 64 is connected between the detection resistor 63 and a plus side terminal of the reference potential source 62. The detection resistor 65 constituting the flowing current detection circuit ID is connected between the auxiliary emitter E1 of the switching element 20A and the reference potential line 12. The auxiliary emitter E1 of the switching element 20A is connected to the minus side input "a" of the current limiting comparator 61, and a mutual connection point between the detection resistors 63 and 64 is connected to the plus side input "b" of the current limiting comparator 61. The reference potential source 62 is the potential source of a constant voltage e, and its plus side terminal is connected to the detection resistor 64 and is connected to the plus side input "b" of the current limiting comparator 61 through this detection resistor 64.

The current limiting transistor 66 is a P-channel MOS transistor. A source S of this transistor 66 is connected to a terminal 30*a* of a current supply circuit 30 and is directly connected to an ignition signal line 11. A drain D of the transistor 66 is connected to a terminal 30*b* of the current supply circuit 30 and is directly connected to a gate and a drain D of an output transistor 31. A gate of the transistor 66 is connected to the output "c" of the current limiting comparator 61.

When a collector current of the switching element 20A flowing through a primary coil 2 of an ignition coil 1 is a limited current or lower, and a potential Va at the minus side input "a" of the current limiting comparator 61 is lower than a potential Vb at the plus side input "b", a high level output is generated at the output "c", and the current limiting transistor 66 is turned off. The current flowing through the primary coil 2 of the ignition coil 1 is increased, the current flowing through the detection resistor 65 is increased, and when the potential Va at the minus side input "a" of the current limiting comparator 61 exceeds the potential Vb at the plus side input "b", the output potential Vc at the output "c" of the current limiting comparator 61 is lowered depending on the magnitude of the potential difference (Va−Vb), the gate voltage of the current limiting transistor 66 is lowered depending on that, and a current flows between the source S and the drain D of the transistor 66. Depending on the current of this current limiting transistor 66, the current of the output transistor 31 of the current supply circuit 30 is bypassed, a current from an output transistor 32 to a drive resistor 20R is decreased, and the potential at the gate G of the switching element 20A is lowered. By the lowering of this gate potential G, the collector current of the switching element 20A is lowered, and the increase of the collector current is limited.

The potential Va at the plus side input "a" of the current limiting comparator 61 is such a potential that the constant potential component e by the reference potential source 62 is added to a proportional potential component ec proportional to a potential at the output terminal 10*a*, that is, the collector C of the switching element 20A. This proportional potential component ec is detected by the detection resistors 63 and 64 of the output voltage detection circuit VD. This proportional potential component ec raises the potential Vb at the plus side input "b" of the current limiting comparator 61 depending on its magnitude. The increase of the proportional potential ec changes the operation characteristic of the current limiting comparator 61, and suppresses the change of the collector voltage Vce of the switching element 20A.

Figure 7:
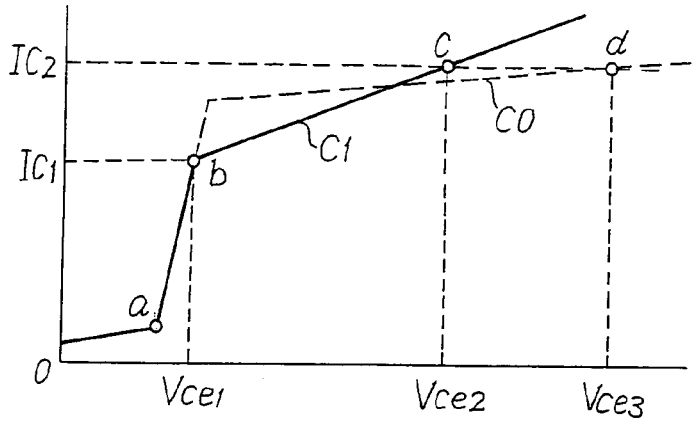
FIG. 7 is a characteristic diagram for explaining the operation of the embodiment 3.

FIG. 7 is an operation explanatory diagram of the current limiting circuit 60, and shows, in a case where an ignition signal voltage Vio is supplied to have such a polarity that the ignition signal line 11 is made plus, a relation between the collector-emitter voltage Vce of the switching element 20A and the collector current Ic. The vertical axis indicates the collector current Ic of the switching element 20A, and the horizontal axis indicates the collector voltage Vce. An operating point "a" is a point where the switching element 20A is turned on as the ignition signal voltage Vi becomes high. From this operating point "a", the switching element 20A starts to supply the current to the primary coil 2 of the ignition coil 1, and the collector current Ic is abruptly increased, and along with this, the collector voltage Vce is also increased. An operating point "b" is a point where the current limiting circuit 60 starts to limit the collector current Ic of the switching element 20A. At this operating point "b", the collector current Ic is Ic1, and the collector voltage Vce is Vce1. At this operating point "b", the potential Va exceeds the potential Vb, the operation that the current limiting transistor 66 bypasses the transistor 31 is started, a drop in the voltage Vg of the gate G occurs, and the limitation of the collector current Ic is started.

In the case where the detection resistors 63 and 64 are not provided, and the proportional potential component ec is not given, it is assumed that the switching element 20A changes from the operating point "b" to an operating point "d" along a characteristic C0 indicated by a dotted line. According to this characteristic C0, at the operating point "d", the collector current Ic of the switching element 20A reaches Ic2, and the collector voltage Vce reaches Vce3. The proportional potential component ec by the detection resistors 63 and 64 gives the current limiting comparator 61 a characteristic equivalent to the case where the operation characteristic from the operating point "b" is changed to a characteristic C1. In this characteristic C1, when the collector current Ic reaches Ic2, an operating point becomes "c", and the collector voltage Vce becomes Vce2 (Vce2<Vce3). That is, as compared with the characteristic C0, the characteristic C1 suppresses the change of the collector voltage Vce, and lessens the change of the collector voltage Vce at the operating point "b" where the current limiting operation is started.

Figure 8:
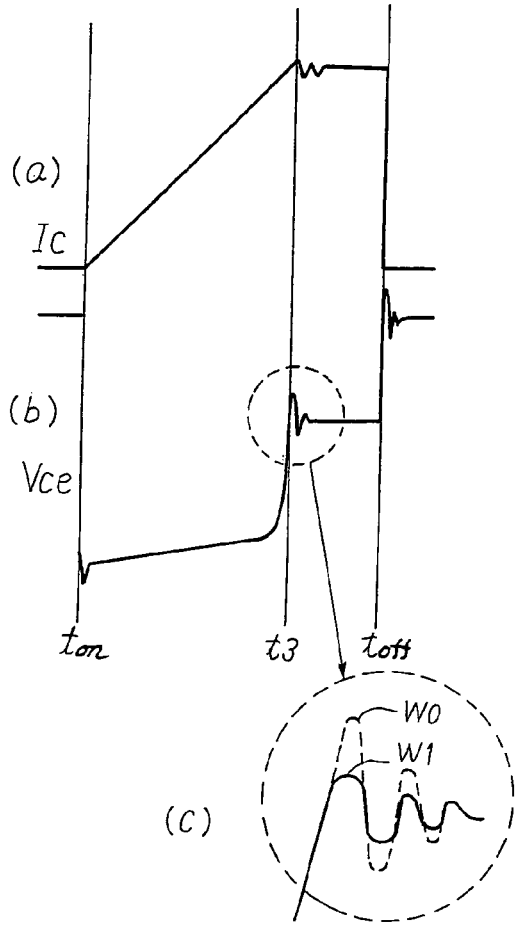
FIG. 8(*a*)(*b*)(*c*) are characteristic diagrams for explaining the operation of the embodiment 3.

FIGS. 8(*a*) to 8(*c*) show waveform changes of the collector current Ic and the collector voltage Vce in the case where the current limiting circuit 60 is added. FIG. 8(*a*) shows the change of the collector current Ic, and FIG. 8(*b*) shows the change of the collector voltage Vce. The horizontal axis in FIGS. 8(*a*) to 8(*c*) indicates the time. At an energization timing ton, the switching element 20A is turned on, the collector current Ic starts to flow, and the collector voltage Vce is abruptly decreased. The collector current Ic is increased, and at a timing t3 when the collector current Ic reaches Ic1, the potential Va exceeds the potential Vb, and the current limiting operation by the current limiting circuit 60 is started. At the start point t3 of the current limiting operation, the collector current Ic pulsates by a large inductance of the primary coil 2 of the ignition coil 1, and there is a fear that the collector voltage Vce also pulsates. The change from the characteristic C0 to the characteristic C1 by the proportional potential component ec suppresses this pulsation.

In a circle of a broken line of FIG. 8(*c*), the pulsation of the collector voltage Vce at the timing t3 is magnified and shown. At the characteristic C0, the pulsation comes to have a pulsation waveform W0 indicated by a broken line, however, on the basis of the change to the characteristic C1 by the proportional potential component ec, the pulsation comes to have a pulsation waveform W1 where the vibration amplitude is suppressed. By the suppressed pulsation waveform W1, it is possible to prevent erroneous ignition from occurring at this timing t3 in the combustion engine.

At an ignition timing toff after the point t3, when the ignition signal voltage Vi is lowered and the feeding to the drive resistor 20R from the current supply circuit 30 is stopped, the switching element 20A is turned off, and the collector current Ic is abruptly lowered, and along with this, a high voltage for ignition is generated in the secondary coil 3 of the ignition coil 1, and ignition occurs in the combustion engine. Incidentally, there is also a case where the ignition timing toff is set to be earlier than the timing t3.

According to the embodiment 3, in the switching circuit 10B which has the three terminals of the output terminal 10*a*, the input terminal 10*b* and the reference potential terminal 10*c* and in which the terminal structure is simplified, the flowing current of the switching element 20A is detected by the flowing current detection circuit ID, and the current limiting transistor 66 decreases the current from the current supply circuit 30 to the drive resistor 20R depending on the increase of the flowing current, so that the switching element 20A can be effectively protected.

In addition, the voltage at the output terminal 10*a*, that is, the collector voltage Vce of the switching element 20A is detected by the output voltage detection circuit VD, the operation characteristic of the comparator 61 at the time of the current limitation is changed, and the pulsation of the collector voltage at the start time of the current limitation is suppressed, so that erroneous ignition to the combustion engine at the start point of the current limitation can be prevented.

Embodiment 4

Figure 9:
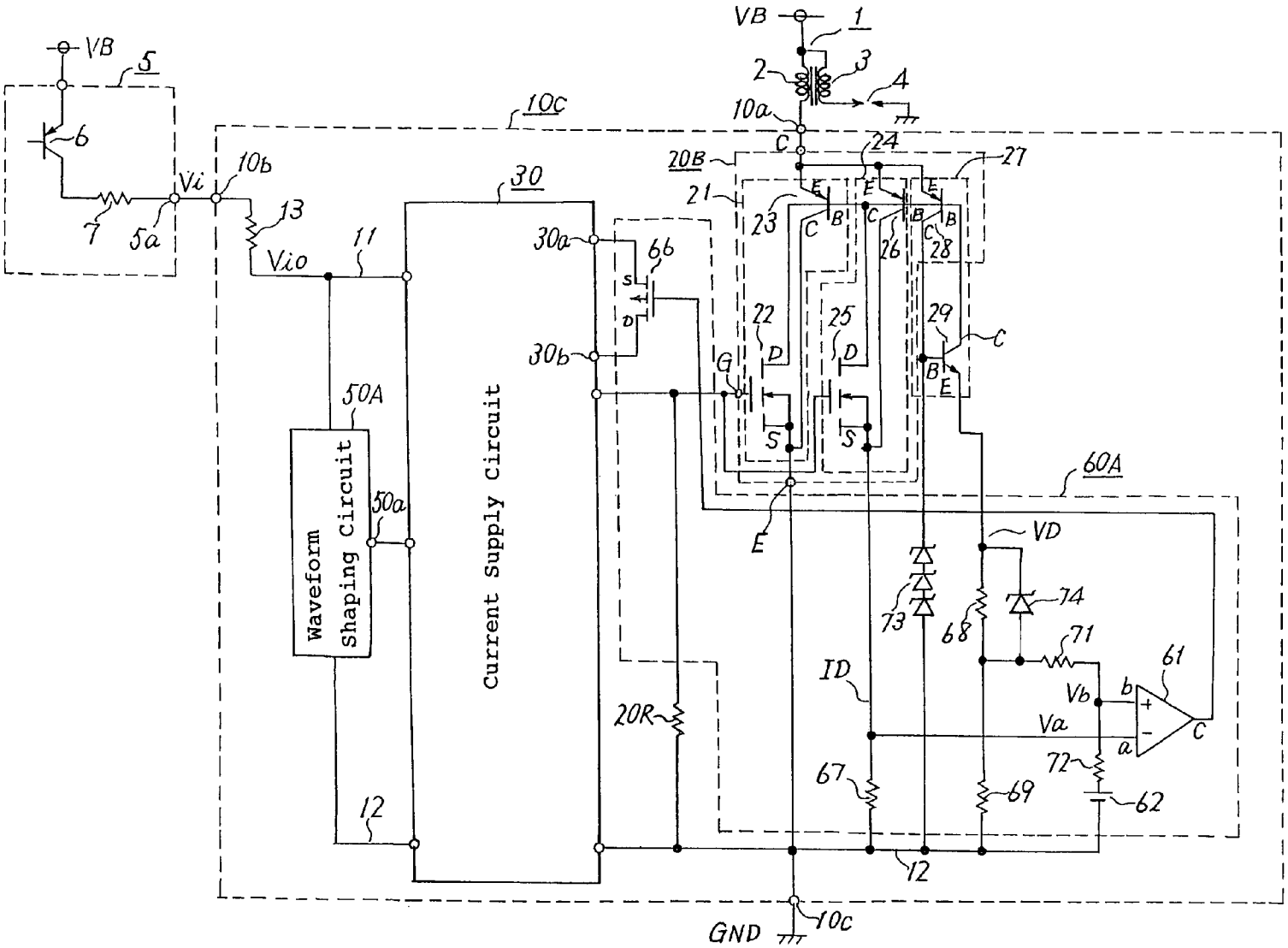
FIG. 9 is an electrical diagram showing embodiment 4 of an internal combustion engine ignition apparatus of the invention.

FIG. 9 is an electrical diagram showing embodiment 4 of an internal combustion engine ignition apparatus of the invention. In the embodiment 4, a switching element 20B obtained by modifying the switching element 20A of FIG. 6 is used, and a current limiting circuit 60A obtained by modifying the current limiting circuit 60 of FIG. 6 is used. Similarly to the embodiment 3 shown in FIG. 6, this embodiment has a function to protect the switching element. In this embodiment 4, since the structure other than the switching element 20B and the current limiting circuit 60A is the same as the embodiment 3 shown in FIG. 6, the same parts are denoted by the same symbols and the explanation will be omitted.

The switching element 20B used in the embodiment 4 is an IGBT, and incorporates a main IGBT 21, a sense IGBT 24 and a latch-up element 27. The main IGBT 21 is such that an N-channel MOS transistor 22 and a PNP bipolar transistor 23 are connected in series to each other. A drain D of the N-channel MOS transistor 22 is connected to a base B of the PNP bipolar transistor 23, and a source S of the N-channel MOS transistor 22 is connected to a collector C of the PNP bipolar transistor 23. An emitter E of the PNP bipolar transistor 23 becomes a collector C of the switching element 20B, and the source S of the N-channel MOS transistor 22 becomes an emitter E of the switching element 20B. A gate G of the N-channel MOS transistor 22 becomes a gate G of the switching element 20B.

The sense IGBT 24 is such that an N-channel MOS transistor 25 and a PNP bipolar transistor 26 are connected in series to each other. A drain D of the N-channel MOS transistor 25 is connected to a base B of the PNP bipolar transistor 26, and a source S of the N-channel MOS transistor 25 is connected to a collector C of the PNP bipolar transistor 26. An emitter E of the PNP bipolar transistor 26 is connected to the collector C of the switching element 20B, and a gate G of the N-channel MOS transistor 25 is connected to the gate G of the switching element 20B.

The latch-up element 27 includes a PNP bipolar transistor 28 and an NPN bipolar transistor 29. A collector C of the PNP bipolar transistor 28 is connected to a base B of the NPN bipolar transistor 29, and a base B of the PNP bipolar transistor 28 is connected in common to the bases B of the PNP bipolar transistors 23 and 26, and is connected to a collector C of the NPN bipolar transistor 29. An emitter E of the PNP bipolar transistor 27 is connected to the collector C of the switching element 20B.

The current limiting circuit 60A includes a current limiting comparator 61, a reference potential source 62, detection resistors 67, 68, 69, 71 and 72, a current limiting transistor 66, a Zener diode group 73, and a Zener diode 74. The detection resistor 67 is connected to the source S of the N-channel MOS transistor 25 of the sense IGBT 24, and constitutes a flowing current detection circuit ID of the switching element 20B. The detection resistors 68, 69, 71 and 72, the Zener diode group 73 and the Zener diode 74 are connected to the NPN transistor 29 of the latch-up element 27, and constitute an output voltage detection circuit VD for detecting the voltage at the collector C of the switching element 20B, that is, the output voltage at the output terminal 10*a*.

The detection resistor 67 of the flowing current detection circuit ID is connected between the source S of the N-channel MOS transistor 25 of the sense IGBT 24 and the reference potential line 12. The Zener diode group 73 of the output voltage detection circuit VD is such that for example, three Zener diodes are connected in series, and is connected between the base B of the NPN bipolar transistor 29 of the latch-up element 27 and the reference potential line 12. In the Zener diode group 73, its cathode is connected to the base B of the NPN bipolar transistor 29, and its anode is connected to the reference potential line 12. The detection resistors 68 and 69 are connected in series to each other between the emitter E of the NPN bipolar transistor 29 of the latch-up element 27 and the reference potential line 12. The Zener diode 74 is connected in parallel to the detection resistor 68, its cathode is connected to the emitter E of the NPN bipolar transistor 29, and its anode is connected to a mutual connection point between the detection resistors 68 and 69. The reference potential source 62 and the detection resistors 71 and 72 are connected in series to each other to form a circuit parallel to the detection resistor 69. A minus side terminal of the reference potential source 62 is connected to the reference potential line 12, and a plus side terminal thereof is connected to a mutual connection point between the detection resistors 68 and 69 through the detection resistors 72 and 71.

A plus side input "b" of the current limiting comparator 61 is connected to a mutual connection point between the detection resistors 71 and 72, a minus side input "a" thereof is connected to a mutual connection point between the detection resistor 67 and the source S of the N-channel MOS transistor 25, and an output "c" thereof is connected to the base of the current limiting transistor 66. A source S and a drain D of the current limiting transistor 66 are connected to terminals 30*a* and 30*b* of a current supply circuit 30, and are directly connected to a source S and a drain D of an output transistor 32 of the current supply circuit 30 similarly to the embodiment 3 shown in FIG. 6.

Figure 10:
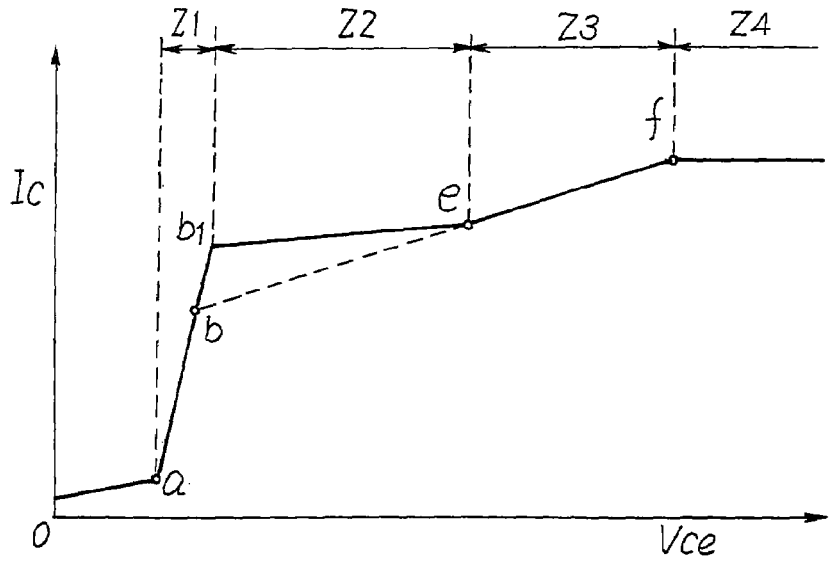
FIG. 10 is a characteristic diagram for explaining the operation of the embodiment 4.

FIG. 10 shows, in the embodiment 4, a characteristic of a collector current Ic flowing from the collector C of the switching element 20B to the emitter E and a collector voltage Vce between the collector C and the emitter E. This characteristic includes operating points "a", "b1", "e" and "f", and includes regions Z1, Z2, Z3 and Z4 between these operating points. The region Z1 is the region between the operating points "a" and "b1", the region Z2 is the region between the operating points "b1" and "e", the region Z3 is the region between the operating point "e" and "f", and the region Z4 is the region higher than the operating point "f".

At the operating point "a", the switching element 20B is turned on, and a current starts to flow through the primary coil 2 of the ignition coil 1. The collector current Ic is abruptly increased from the operating point "a" to the operating point "b1". When the collector current of the switching element 20B flowing through the primary coil 2 of the ignition coil 1 is a limited current or lower, and the potential Va at the minus side input "a" of the current limiting comparator 61 is lower than the potential Vb at the plus side input "b", a high level output is generated at the output "c" of the current limiting comparator 61, and the current limiting transistor 66 is turned off. The current flowing through the primary coil 2 of the ignition coil 1 is increased, the current flowing through the detection resistor 67 is increased, and when the potential Va at the minus side input "a" of the current limiting comparator 61 exceeds the potential Vb at the plus side input "b", the output potential Vc at the output "c" of the current limiting comparator 61 is lowered depending on the magnitude of a potential difference (Va−Vb), the gate potential of the current limiting transistor 66 is lowered depending on that, and the drain current flows between the source S and the drain D of the transistor 66. Depending on the drain current of the current limiting transistor 66, the current between the source and the drain of the transistor 31 of the current supply circuit 30 is bypassed, the current from the transistor 32 to the drive resistor 20R is decreased, and the potential at the gate G of the switching element 20B is lowered. By the lowering of the gate potential G, the collector current of the switching element 20B is lowered, and the increase of the collector current is limited.

In the regions Z1 and Z2, both the Zener diode group 73 and the Zener diode 74 are turned off, and the plus side input Vb of the current limiting comparator 61 is increased depending on a constant voltage component "e" of the reference potential source 92 and a proportional voltage component ec. In the region Z3, the Zener diode group 73 is turned off, and the Zener diode 74 is turned on. On the basis of the on of the Zener diode 74, the voltage at both ends of the detection resistor 68 is clamped by the Zener diode 74, so that a voltage component exceeding the clamp voltage of the Zener diode 74 is concentrated on the detection resistor 69. As a result, since the plus side input Vb of the current limiting comparator 61 is changed more greatly, the inclination of the change of the collector current Ic with respect to the collector voltage Vce in the region Z3 becomes large as compared with the region Z2. In the region Z4, the Zener diode group 73 is also turned on. Thus, the detection voltage at both ends of the detection resistors 68 and 69 is clamped by the Zener diode group 73, and does not increase more than that. Thus, in the region Z4, the increase of the plus side input Vb of the current limiting comparator 61 is suppressed by the Zener diode group 73, the potential at the output "c" of the current limiting comparator 61 is decreased in accordance with the detection voltage of the detection resistor 67, and the suppression effect of the collector current Ic becomes great.

Figure 11:
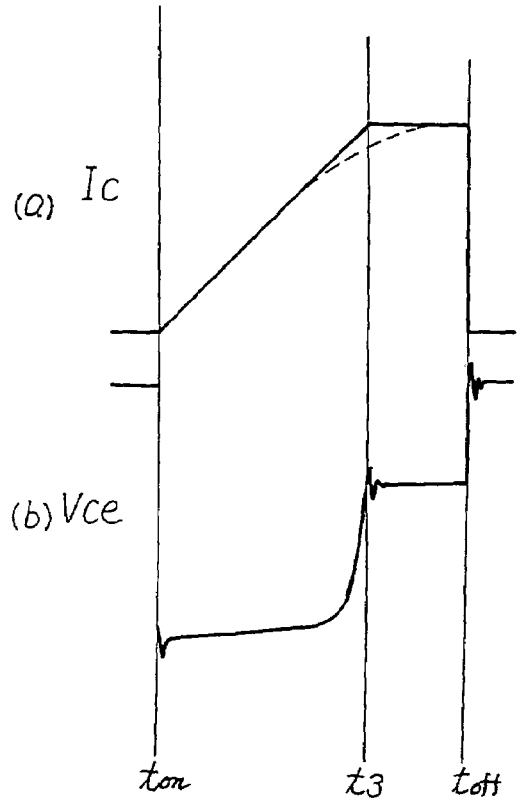
FIG. 11(*a*) (*b*) are characteristic diagrams for explaining the operation of the embodiment 4.

FIGS. 11(*a*) and 11(*b*) show waveform changes of the collector current Ic and the collector voltage Vce of the switching element 20B in the case where the current limiting circuit 60A is added. FIG. 11(*a*) shows the change of the collector current Ic, and FIG. 11(*a*) shows the change of the collector voltage Vce. The horizontal axis of each of FIGS. 11(*a*) and 11(*b*) indicates the time. At an energization timing ton, the switching element 20B is turned on, the collector current Ic starts to flow, and the collector voltage Vce is abruptly decreased. The collector current Ic is increased, and at a point t3 when the collector current Ic is increased, the potential Va exceeds the potential Vb, and the current limiting operation by the current limiting circuit 60A is started. This current limiting operation is changed stepwise in the regions Z2 and Z3, and the pulsation of the collector voltage Vce is more effectively suppressed. The operating point "e" becomes a bent point of the current limiting operation, and in the region Z2 where the collector voltage Vce is lower than this operating point "e", as compared with the region Z3 where the collector voltage Vce is higher than the operating point "e", the inclination of the collector current Ic with respect to the collector voltage Vce is small.

The bending of the current limiting operation at this operating point "e" gives the sufficient collector current Ic to the switching element 20B, and gives the stepwise current limiting operation. In the embodiment 3 shown in FIG. 6, the current limiting operation in accordance with the characteristic C1 is given from the operating point "b", and the pulsation of the collector voltage Vce at the operating point "b" is prevented. On the other hand, in this embodiment 4, the current limiting operation is given from the region where the collector current Ic is small, and as a result, the collector current Ic is suppressed, and the flowing current of the switching element 20A is decreased. In the embodiment 4, the current limiting operation is set to the operating point "b1" where the collector current Ic is larger than that at the operating point "b", the collector current Ic is made larger, and a more sufficient flowing current is made to flow through the primary coil 2 of the ignition coil 1.

The current limiting operation in the region Z2 corresponds to the characteristic C0 of FIG. 7, and the current limiting operation in the region Z3 corresponds to the characteristic C1 of FIG. 7. As stated above, when the current limiting operation is bent at the operating point "e" and is changed stepwise, as shown in FIG. 11(*a*), the sufficient collector current Ic can be made to flow in the vicinity of the timing t3, and the collector voltage variation can be suppressed in the state where the voltage at the power supply terminal VB is high.

At an ignition timing toff after the timing t3, when the feeding from the current supply circuit 30 to the drive resistor 20R is stopped as the ignition signal voltage Vi is lowered, the switching element 20B is turned off, and the collector current Ic is abruptly lowered, and along with this, a high voltage for ignition is generated in the secondary coil 3 of the ignition coil 1, and ignition is performed in the combustion engine.

According to the embodiment 4, in the switching circuit 10B which has the three terminals of the output terminal 10*a*, the input terminal 10*b*, and the reference potential terminal 10*c* and in which the terminal structure is simplified, the current from the current supply circuit 30 to the drive resistor 20R is decreased by the current limiting transistor 66 of the current limiting circuit 60A, and the current to the primary coil 2 of the ignition coil 1 can be effectively limited.

In addition, the Zener diode group 73 and the Zener diode 74 are provided in the circuit for detecting the collector voltage Vce of the switching element 20B, and the detection of the collector voltage Vce is changed stepwise to suppress the pulsation of the collector voltage at the start time of the current limitation and in the state where the voltage at the power supply terminal VB is high. Thus, while erroneous ignition to the internal combustion engine at the start point of the current limitation is prevented, the sufficient flowing current is made to flow through the primary coil 2 of the ignition coil 1, and the sufficient ignition voltage can be obtained.

In the embodiment 4, when the collector current at the time of the current limitation is made IcL, the collect voltage VceL at the time of the current limitation is given by a following expression.

$$VceL = VB - R1 \times IcL$$

VB denotes the voltage at the power supply terminal VB, and R1 denotes the resistance of the primary coil 2 of the ignition coil 1. When the resistor R1 is made 0.5 to 0.7 Ω, the collector current IcL at the time of the current limitation is made 9 toll A, and the power supply voltage VB is made 14 V, the collector voltage VceL at the time of the current limitation becomes 6.3 to 9.5 V. By setting the operating point "e" to approximately 10V, while the erroneous ignition to the internal combustion engine at the start point of the current limitation is prevented, the sufficient flowing current can be made to flow through the primary coil 2 of the ignition coil 1, and the sufficient high voltage for the ignition can be obtained.

Figure 12:
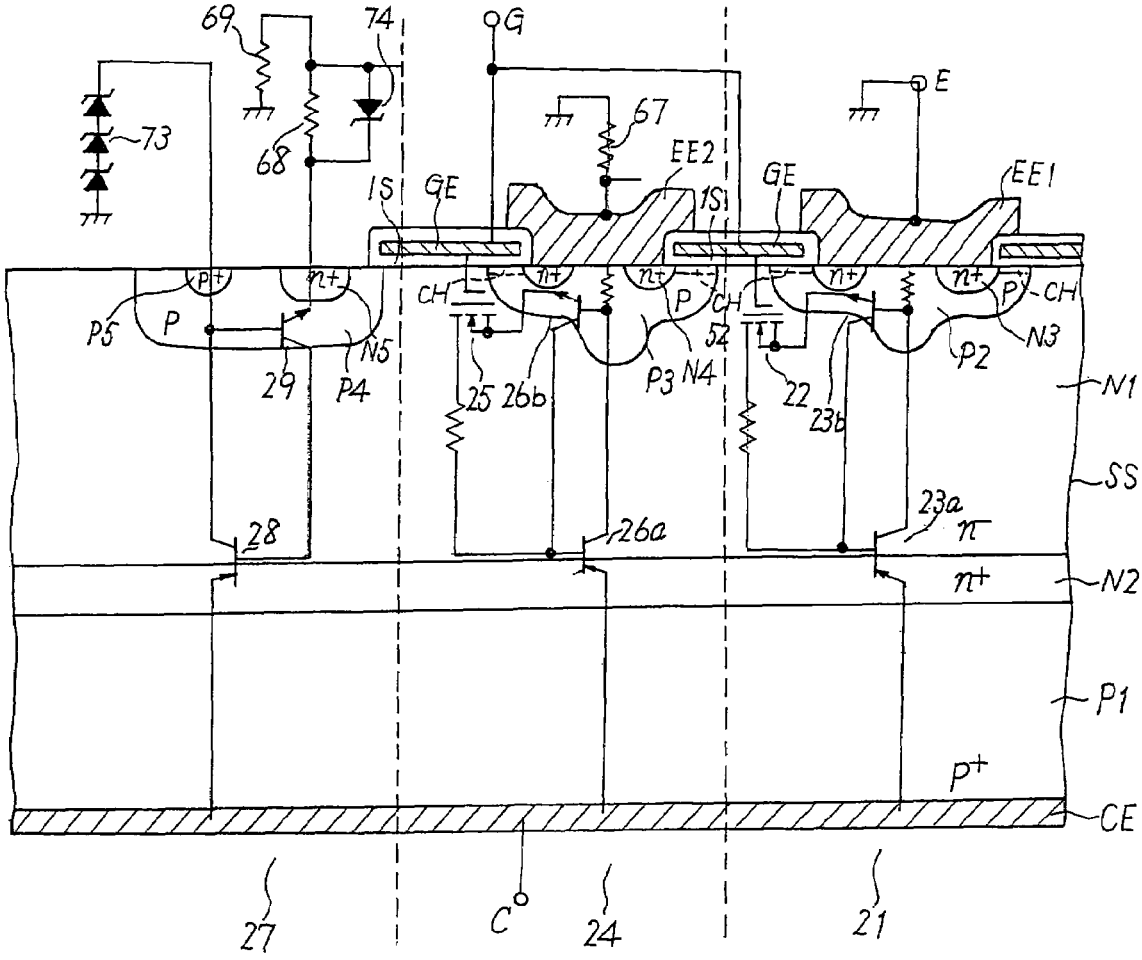
FIG. 12 is a sectional view showing an IGBT used in the embodiment 4.

FIG. 12 shows a specific example of the switching element 20B used in the embodiment 4. This switching element 20B is constructed by a semiconductor substrate. SS of silicon or the like. This semiconductor substrate SS includes an $n^-$-type semiconductor layer N1, an $n^+$-type semiconductor layer N2, and a $p^+$-type semiconductor layer P1. The semiconductor layer N2 is joined to the lower part of the semiconductor layer N1, and the semiconductor layer P1 is joined to the lower part of the semiconductor layer N2. A collector electrode layer CE is in ohmic contact with the semiconductor layer P1, and this collector electrode layer CE becomes the collector C.

P-type semiconductor regions P2, P3 and P4 are formed in the surface of the semiconductor layer N1 to be spaced from each other. The right island region P2 forms the main IGBT 21, an $n^+$-type semiconductor layer N3 is formed in the surface of this island region P2, and an emitter electrode EE1 in ohmic contact with the island region P2 and the semiconductor layer N3 is disposed. This emitter electrode EE1 becomes the emitter E of the switching element 20B. The main IGBT 21 is constituted by plural IGBTs to raise the current capability. The center island region P3 forms the sense IGBT 24, an $n^+$-type semiconductor layer N4 is formed in the surface of the island region P3, and an emitter electrode EE2 in ohmic contact with the island region P3 and the semiconductor layer N4 is disposed. The left island region P4 forms the latch-up element 27, and an $n^+$-type semiconductor layer N5 and a $p^+$-type semiconductor layer P5 are formed in the surface of the island region P4. The emitter electrode EE2 is electrically separated from the emitter electrode EE1.

A gate electrode GE is disposed around the island region P2. This gate electrode GE is disposed to be opposite to the surface of the semiconductor layer N1 positioned around the island region P2 and the surface of the outer peripheral part of the island region P2 positioned between the semiconductor layers N1 and N3 through an insulating film IS such as a silicon oxide film, and controls a channel CH of the surface of the outer peripheral part of the island region P2 positioned between the semiconductor layers N1 and N3. The gate electrode GE constitutes the gate G of the switching element 20B. The gate electrode GE is disposed around the island region P3, and also controls a channel CH of the surface of the outer peripheral part of the island region P3 positioned between the semiconductor layers N1 and N4.

In the right main IGBT 21 of FIG. 12, an N-channel MOS transistor 22, a PNP bipolar transistor 23*a*, and an NPN bipolar transistor 23*b* are constructed. The N-channel MOS transistor 22 is constructed such that the semiconductor layer N3 is a source S, the semiconductor N1 is a drain D, and the gate electrode GE is a gate G. The PNP bipolar transistor 23*a* is constructed such that the semiconductor layer P1 is an emitter, the semiconductor layers N1 and N2 are a base, and the island region P2 is a collector. Besides, the NPN bipolar transistor 23*b* is constructed such that the semiconductor layers N1 and N2 are a collector, the island region P2 is a base, and the semiconductor layer N3 is an emitter. In the PNP bipolar transistor 23*a* and the NPN bipolar transistor 23*b*, the collector of the PNP bipolar transistor 23*a* and the base of the NPN bipolar transistor 23*b* are connected to each other, and the base of the PNP bipolar transistor 23*a* and the collector of the NPN bipolar transistor 23*b* are connected to each other. The PNP bipolar transistor 23 of FIG. 7 is constructed by these transistors 23*a* and 23*b*.

In the center sense IGBT 24 of FIG. 12, an N-channel MOS transistor 25, a PNP bipolar transistor 26*a* and an NPN bipolar transistor 26*b* are constructed. The N-channel MOS transistor 25 is constructed such that the semiconductor layer N4 is a source S, the semiconductor layer N1 is a drain D, and the gate electrode GE is a gate G. The PNP bipolar transistor 26*a* is constructed such that the semiconductor layer P1 is an emitter, the semiconductor layers N1 and N2 are a base, and the island region P3 is a collector, and the NPN bipolar transistor 26*b* is constructed such that the semiconductor layers N1 and N2 are a collector, the island region P3 is a base, and the semiconductor layer N4 is an emitter. In the PNP bipolar transistor 26*a* and the NPN bipolar transistor 26*b*, the collector of the PNP bipolar transistor 26*a* and the base of the NPN bipolar transistor 26*b* are connected to each other, and the base of the PNP bipolar transistor 26*a* and the collector of the NPN bipolar transistor 26*b* are connected to each other. The PNP bipolar transistor 26 of FIG. 9 is constructed by these transistors 26*a* and 26*b*. The detection resistor 67 is connected to the emitter electrode EE2.

In the left latch-up element 27 of FIG. 12, a PNP bipolar transistor 28 and an NPN bipolar transistor 29 are constructed. The PNP bipolar transistor 28 is constructed such that the semiconductor layer P1 is an emitter, the semiconductor layers N1 and N2 are a base, and the island region P4 is a collector. The NPN bipolar transistor 29 is constructed such that the semiconductor layers N1 and N2 are a collector, the island region P4 is a base, and the semiconductor layer N5 is an emitter. The detection resistors 68 and 69 are connected to the semiconductor layer N5, and the Zener diode 74 is connected to the detection resistor 68. The Zener diode group 73 is connected to the semiconductor layer P5.

Embodiment 5

Figure 13:
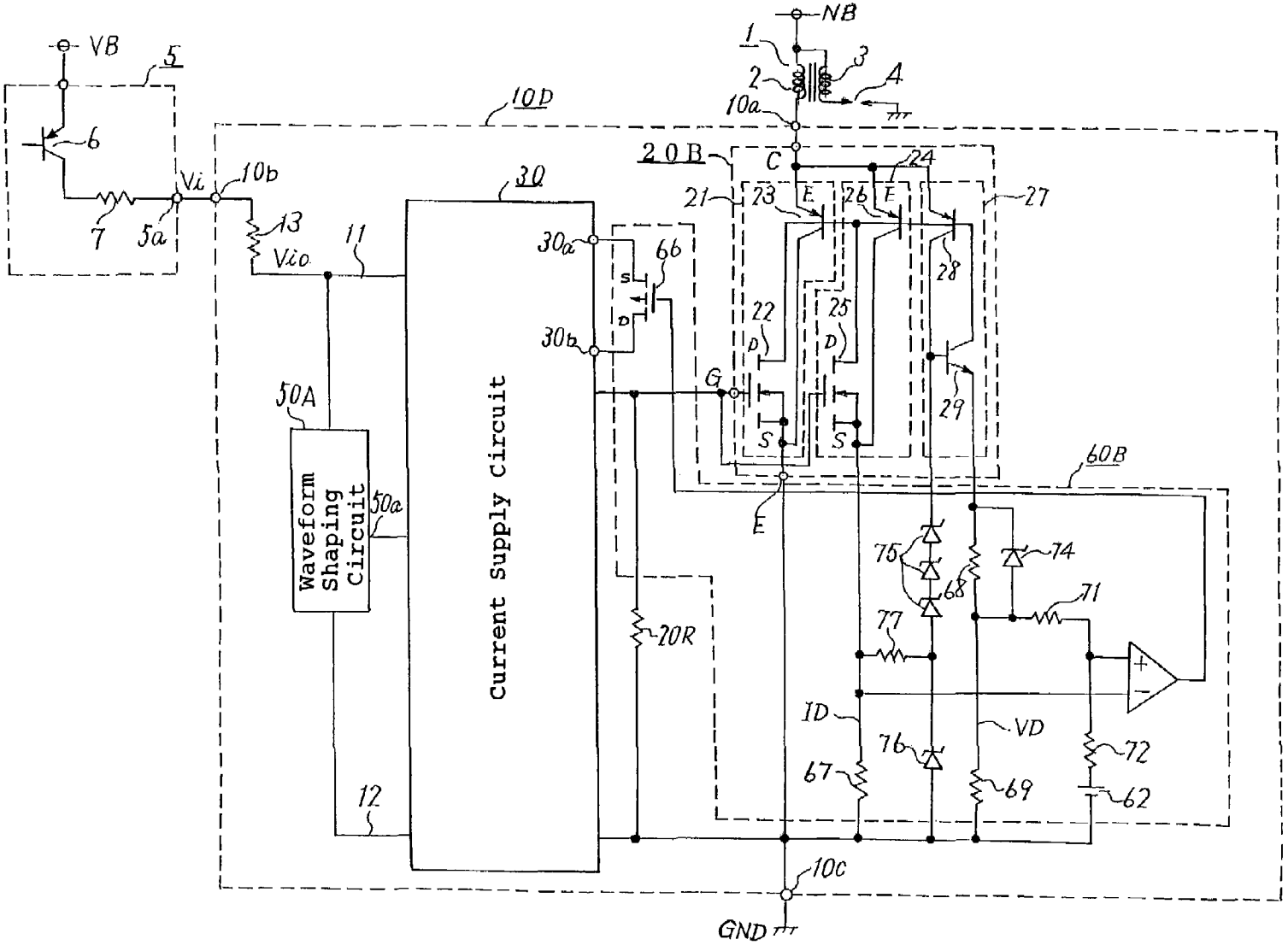
FIG. 13 is an electrical diagram showing embodiment 5 of an internal combustion engine ignition apparatus of the invention.

FIG. 13 shows embodiment 5 of an internal combustion engine ignition apparatus of the invention. This embodiment 5 uses a current limiting circuit 60B obtained by slightly modifying the current limiting circuit 60A of the embodiment 4 shown in FIG. 9. Since the structure other than the current limiting circuit 60B is the same as the embodiment 4, the same parts are denoted by the same symbols and the explanation will be omitted. Also in this embodiment 5, the IGBT 20B shown in FIG. 10 is used.

The current limiting circuit 60B of this embodiment 5 is such that a Zener diode group 75 and a Zener diode 76 are connected to a base of an NPN bipolar transistor 29 of a latch-up element 27, and these are connected to a detection resistor 67 through a resistor 77. The Zener diode group 75 and the Zener diode 76 are connected in series to each other between the base B of the NPN bipolar transistor 29 and a reference potential line 12. A cathode of the Zener diode group 75 is connected to the base B of the NPN bipolar transistor 29, a cathode of the Zener diode 76 is connected to an anode of the Zener diode group 75, and an anode of the Zener diode 76 is connected to the reference potential line 12. The resistor 77 is connected to a mutual connection point between the Zener diode group 75 and the Zener diode 76, and to a mutual connection point between the detection resistor 67 and a source S of an N-channel MOS transistor 25.

In this embodiment 5, after the Zener diode 74 is turned on, until the Zener diode group 75 and the Zener diode 76 are turned on, the operation similar to the embodiment 4 is performed, and the operation similar to the embodiment 4 is performed up to the operating point "f" shown in FIG. 10. When the collector voltage Vce is abnormally increased from the operating point "e" and reaches the operating point "f", the Zener diode group 75 and the Zener diode 76 are turned on, the detection voltage of the detection resistor 67 is clamped by the Zener diode 76, and even if the collector current Ic of the switching element 20B is increased thereafter, the current of the current limiting transistor 66 is not increased, and the current limitation on the same level continues. By this, the limiting operation of the collector current Ic in the region Z4 of FIG. 10 is made constant, and the further limiting operation is stopped. In the embodiment 5, in this region Z4, the gate voltage Vg of the switching element 20B becomes a constant voltage. This gate voltage Vg keeps the switching element 20B in the on state, and keeps it in the state where the flowing current is sufficiently low, and even if the collector voltage Vce is abnormally increased, it prevents a large current from flowing through the switching element 20B. Alternatively, a state in which the gate voltage Vg does not exceed the threshold voltage Vth of the switching element 20B is kept, and the state is produced in which the switching element 20B is not energized.

Embodiment 6

Figure 14:
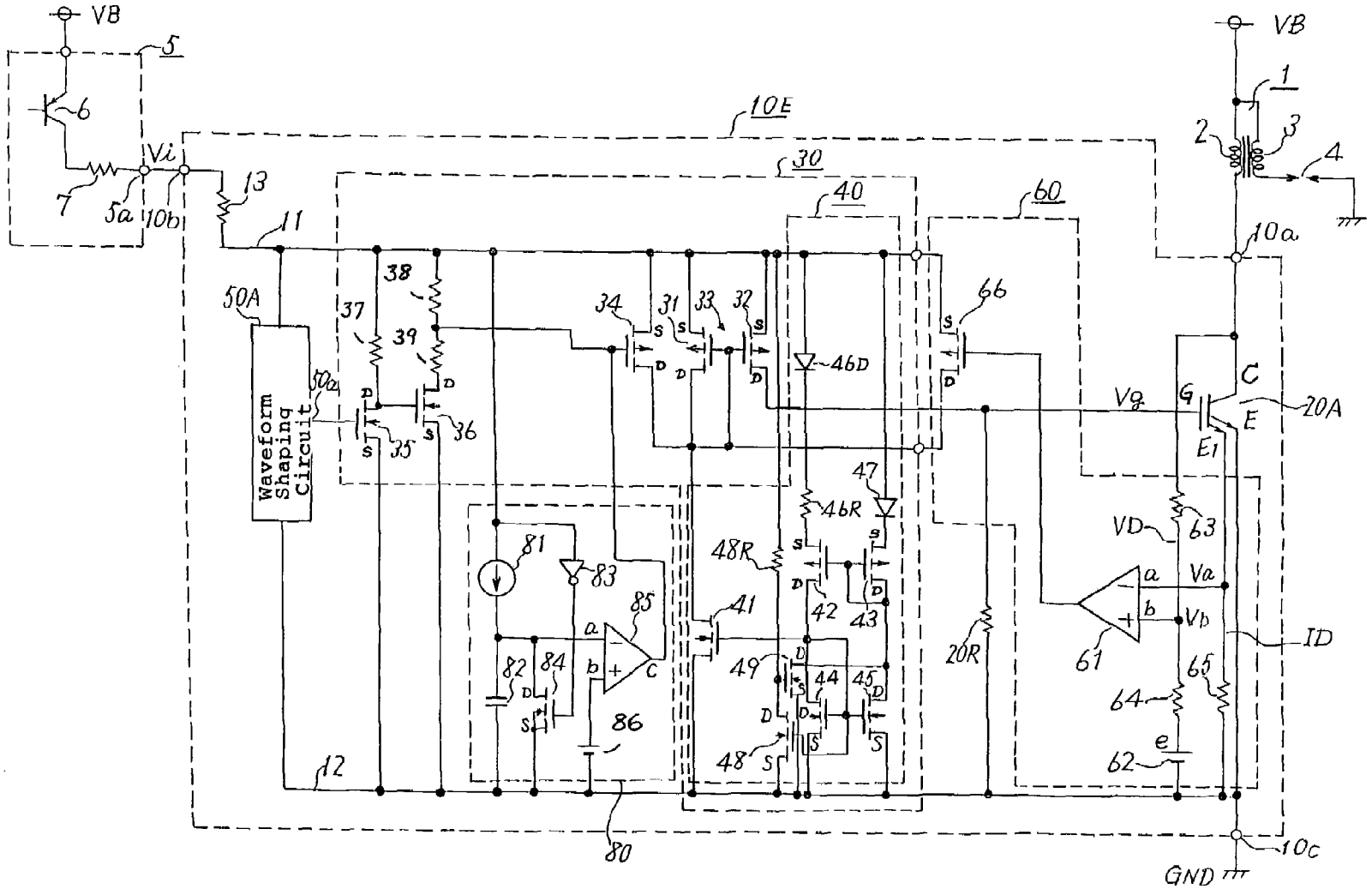
FIG. 14 is an electrical diagram showing embodiment 6 of an internal combustion engine ignition apparatus of the invention.

FIG. 14 shows embodiment 6 of an internal combustion engine ignition apparatus of the invention. This embodiment 6 uses a switching circuit 10E and is such that an over-energization protection circuit 80 is added to the embodiment 3 shown in FIG. 6. Since the other structure is the same as FIG. 6, the same parts are denoted by the same symbols and the explanation will be omitted.

When an energization time to a primary coil 2 of an ignition coil 1 becomes a predetermined value or more, the over-energization protection circuit 80 causes a switching element 20A to be forcibly turned off, and protects a circuit. This over-energization protection circuit 80 includes a constant current source 81, a capacitor 82, an inverter 83, an N-channel MOS transistor 84 and an over-energization comparator 85.

The constant current source 81 and the capacitor 82 are connected in series to each other between an ignition signal line 11 and a reference potential line 12, and the constant current source 81 charges the capacitor 82 by constant current. The N-channel MOS transistor 84 is provided in a discharge circuit of the capacitor 82, its drain D is connected to a connection point between the constant current source 81 and the capacitor 82, and its source S is connected to the reference potential line 12. An input of the inverter 83 is connected to the ignition signal line 11, and an output thereof is connected to a gate of the N-channel MOS transistor 84. The over-energization comparator 85 includes a minus side input "a", a plus side input "b", and an output "c". The minus side input "a" is connected to a connection point between the constant current source 81 and the capacitor 82, and receives a voltage at both ends of the capacitor 82. The plus side input "b" is connected to a plus terminal of a constant potential source 86, and receives a constant potential from this constant potential source 86.

When receiving an ignition signal Vi, the constant current source 81 supplies the constant current to the capacitor 82, and charges the capacitor 82. The voltage of the capacitor 82 rises depending on the lapse of time from a rising point of the ignition signal Vi. When the voltage of this capacitor 82 reaches a predetermined value, and the input "a" exceeds the input "b", the output "c" of the over-energization comparator 85 comes to have a low level, a bypass transistor 34 is turned on, the supply of current from a transistor 32 to a drive resistor 20R is stopped, a gate voltage Vg of the switching element 20A is lowered, and the switching element 20A is turned off.

At the time of engine failure of the internal combustion engine or by a potential difference at a reference potential point of an electrical control unit (ECU), in the case where the ignition signal voltage Vio is kept long in such a polarity that the ignition signal line 11 is made plus, in accordance with this, an energization time to the primary coil 2 of the ignition coil 1 becomes long. When the energization time becomes abnormally long and becomes a predetermined time or longer, the over-energization protection circuit 80 forcibly turns off the switching element 20A to interrupt the energization to the ignition coil 1, and protects the switching element 20A and its driving circuit. When the ignition signal Vi comes to have a low level, the inverter 83 turns on the N-channel MOS transistor 84, and discharges the capacitor 82.

In the embodiment 6, the switching circuit 10E is constructed by the three terminals 10*a*, 10*b* and 10*c*, and the terminal structure can be simplified. Further, the collector current of the switching element 20A is limited by the current limiting circuit 60A, and when the energization time of the switching element 20A becomes abnormally long, the switching element 20A is forcibly turned off, and the switching element 20A and its driving circuit can be protected.

Incidentally, in the embodiment 6, a current supply circuit 30 including a constant current circuit 40, a waveform shaping circuit 50A, the current limiting circuit 60 including a flowing current detection circuit ID and an output voltage detection circuit VD, and the over-energization protection circuit 80 can also be formed integrally on one common semiconductor substrate as a one chip semiconductor circuit.

The over-energization protection circuit 80 of this embodiment 6 can also be used for the switching circuit 10 of the embodiment 1 shown in FIG. 1, the switching circuit 10A of the embodiment 2 shown in FIG. 4, the switching circuit 10B of the embodiment 3 shown in FIG. 6, the switching circuit 10C of the embodiment 4 shown in FIG. 9, and the switching circuit 10D of the embodiment 5 shown in FIG. 13. In any case, the over-energization protection circuit 80 is combined so that the output "c" of the over-energization protection circuit comparator 85 drives the bypass transistor 34.

The internal combustion engine ignition apparatus of the invention is used as an ignition apparatus for an internal combustion engine mounted in an automobile. Besides, it can also be used as an ignition apparatus of an internal combustion engine mounted in a ship, or an internal combustion engine used as an electric generator for household use or for agriculture.

What is claimed is:

1. An internal combustion engine ignition apparatus, comprising:

an ignition coil having a primary coil and a secondary coil; and a switching circuit which interrupts a current of the primary coil of the ignition coil on the basis of an ignition signal voltage to generate a high voltage for ignition in the secondary coil of the ignition coil, wherein the ignition signal voltage is a pulse-like voltage including a rising portion and a falling portion, the switching circuit has no power supply terminal connected to a battery and includes an output terminal connected to the primary coil of the ignition coil, an input terminal for receiving the ignition signal voltage, and a reference potential terminal, the switching circuit includes a switching element which is connected between the output terminal and the reference potential terminal, applies a current to the primary coil of the ignition coil in an on state, and interrupts the current of the primary coil when an of f state is caused, a drive resistor for the switching element, a current supply circuit which is connected between the input terminal and the reference potential terminal and supplies a driving current to the drive resistor, and a waveform shaping circuit which controls the driving current from the current supply circuit to the drive resistor, brings the switching element into the on state on the basis of supply start of the driving current, and brings the switching element into the off state on the basis of supply interruption of the driving current, and the waveform shaping circuit includes a comparison signal generation circuit for generating a comparison signal on the basis of the ignition signal voltage, and a reference signal generation circuit for generating a reference signal on the basis of the ignition signal voltage, starts to supply the driving current to the drive resistor when the comparison signal becomes larger than the reference signal in the rising portion of the ignition signal voltage, and interrupts the driving current when the comparison signal becomes smaller than the reference signal in the falling portion of the ignition signal voltage.

2. An internal combustion engine ignition apparatus according to claim 1, wherein the switching circuit includes an ignition signal line connected to the input terminal, and a reference potential line connected to the reference potential terminal, and both of the current supply circuit and the waveform shaping circuit are connected between the ignition signal line and the reference potential line.

3. An internal combustion engine ignition apparatus according to claim 2, wherein the current supply circuit includes an output transistor for supplying the driving current, and a control transistor for on/off controlling the output transistor, the waveform shaping circuit includes a comparator for comparing the comparison signal with the reference signal, and the control transistor is controlled on the basis of an output of the comparator to control the driving current.

4. An internal combustion engine ignition apparatus according to claim 3, wherein the waveform shaping circuit further includes a level up circuit operating in accordance with the output of the comparator, and the level up circuit raises a level of the comparison signal when the supply of the driving current is started in the rising portion of the ignition signal voltage.

5. An internal combustion engine ignition apparatus according to claim 2, wherein the current supply circuit further includes a constant current circuit connected between the ignition signal line and the reference potential line, the constant current circuit generates a constant current on the basis of the ignition signal voltage and causes the driving current supplied from the current supply circuit to the drive resistor to become constant.

6. An internal combustion engine ignition apparatus according to claim 5, wherein the constant current circuit includes a constant current transistor for generating the constant current, and the constant current transistor is connected to the output transistor to perform constant-current driving of the output transistor of the current supply circuit.

7. An internal combustion engine ignition apparatus according to claim 2, wherein the switching circuit further includes a current limiting circuit for limiting a flowing current of the switching element.

8. An internal combustion engine ignition apparatus according to claim 7, wherein the current limiting circuit includes a flowing current detection circuit for detecting the flowing current of the switching element, reduces the driving current from the current supply circuit to the drive resistor depending on an increase of the flowing current, and reduces the flowing current of the switching element.

9. An internal combustion engine ignition apparatus according to claim 8, wherein the switching element is an IGBT, the switching element includes an emitter and an auxiliary emitter, and the flowing current detection circuit is connected to the auxiliary emitter.

10. An internal combustion engine ignition apparatus according to claim 8, wherein the switching element is an IGBT having a sense IGBT, and the flowing current detection circuit is connected to the sense IGBT.

11. An internal combustion engine ignition apparatus according to claim 7, wherein the current limiting circuit includes an output voltage detection circuit for detecting an output voltage at the output terminal, and changes a current limiting characteristic for the switching element depending on the detected voltage of the output voltage detection circuit.

12. An internal combustion engine ignition apparatus according to claim 11, wherein the output voltage detection circuit includes a voltage changing unit for changing the detected voltage stepwise as the output voltage is increased, and the current limiting characteristic for the switching element is changed stepwise.

13. An internal combustion engine ignition apparatus according to claim 12, wherein a bent point is provided in the current limiting characteristic, and in a region of the output voltage at a side lower than the bent point, as compared with a region of the output voltage higher than the bent point, an inclination of the flowing current of the switching element with respect to the output voltage is made small.

14. An internal combustion engine ignition apparatus according to claim 11, wherein the switching element is an IGBT, and the output voltage detection circuit is connected to a latch-up transistor constructed in the IGBT.

15. An internal combustion engine ignition apparatus according to claim 2, wherein the switching circuit includes an output voltage detection circuit for detecting an output voltage at the output terminal, and when the output voltage is increased, a flowing current of the switching element is reduced or interrupted.

16. An internal combustion engine ignition apparatus according to claim 2, wherein the switching circuit includes an over-energization protection circuit, and when an energization time of the switching element becomes equal to or longer than a specified time, the over-energization protection circuit turns off the switching element.

17. An internal combustion engine ignition apparatus according to claim 2, wherein the switching circuit includes a current limiting circuit for limiting a flowing current of the switching element, a output voltage detection circuit for detecting a voltage at the output terminal and reducing the current of the switching element when the voltage at the output terminal is increased, and an over-energization protection circuit for turning off the switching element when an energization time of the switching element becomes a specified time or longer.

18. An internal combustion engine ignition apparatus according to claim 17, wherein the current limiting circuit, the output voltage detection circuit, and the over-energization protection circuit, together with the current supply circuit and the waveform shaping circuit, are integrated on a common semiconductor substrate.

* * * * *